US008702102B1

(12) United States Patent
Rohrmeister

(10) Patent No.: US 8,702,102 B1
(45) Date of Patent: Apr. 22, 2014

(54) SOCIAL CARD GAME—HAPPY JOURNEY TO LOVE

(71) Applicant: Thomas Christian Rohrmeister, Klagenfurt (AT)

(72) Inventor: Thomas Christian Rohrmeister, Klagenfurt (AT)

(73) Assignee: Thomas Ch. Rohrmeister, Klagenfurt, Austria (EP), part interest ( * ) Notice: Subject to any disclaimer, the term of this patent is extended or adjusted under 35 U.S.C. 154(b) by 0 days.

(21) Appl. No.: 13/684,181

(22) Filed: Nov. 22, 2012

Related U.S. Application Data

(60) Provisional application No. 61/563,497, filed on Nov. 23, 2011.

(51) Int. Cl.
*A63F 1/00* (2006.01)
*A63F 3/00* (2006.01)

(52) U.S. Cl.
USPC ..... 273/236; 273/292; 273/296; 273/298; 273/308

(58) Field of Classification Search
USPC ..... 273/292, 296, 297, 298, 300, 308, 236, 273/273, 278
See application file for complete search history.

(56) References Cited

U.S. PATENT DOCUMENTS

| | | | | |
|---|---|---|---|---|
| 1,314,522 | A * | 9/1919 | Knoos, Jr. | 273/292 |
| 5,213,509 | A * | 5/1993 | Gunn | 434/236 |
| 5,778,700 | A * | 7/1998 | Lee et al. | 62/656 |
| 2001/0042962 | A1 * | 11/2001 | Simmons | 273/431 |
| 2010/0140871 | A1 * | 6/2010 | Nouma | 273/292 |
| 2010/0181721 | A1 * | 7/2010 | Janicek et al. | 273/243 |
| 2010/0219584 | A1 * | 9/2010 | Dang et al. | 273/292 |
| 2010/0253000 | A1 * | 10/2010 | Creger | 273/292 |

OTHER PUBLICATIONS

"Das Wettrennen" by J.W. Spear in "Games We Play"—History of J.W. Spear & Son 1997 ISBN: 3921590515 by Helmut Schwarz/Marion Faber—in english "The Steeple Chase" by J.W. Spear. Inventary Statement Museum Nuernberg—Das Wettrennen—The Steeple Chase attached Image-Description JPG_DAS_Wettrennen by J.W. Spear & Brothers source-code: http://www.ebay.de/itm/Antikes-schones-Wettrennen-Spiel-in-OVP-um-1900-/390671092050?pt=Antikspielzeug&hash=item5af5cfc952#ht_2712wt_998, 1904.

* cited by examiner

*Primary Examiner* — Benjamin Layno

(57) ABSTRACT

Presented is a method for playing a social card game with a plurality of players and a dealer. The method includes providing at least two decks that each contain a plurality of social game playing cards that have indicia on a front surface of the card and on a back surface of the card. Each deck of playing cards is assigned a monetary value. The method also includes providing a playing surface having indicia indicating where players are to be positioned and markings including at least three frames indicating where playing cards are to be placed during play. The dealer sells at least one playing card to each of the players and then signals the start of a hand. The dealer selects a first player to begin and that player, in a non-verbal manner, offers at least one playing card to a second player who selects one of the at least three frames to place the offered playing card. Based on the where the offered playing card is placed, a determination is made to continue play with another player without loss of the offered playing card, or to continue play with another player with loss of the offered playing card, or to continue play because the second player directed the dealer to turn the offered card face-up.

20 Claims, 13 Drawing Sheets

SOCIAL CARD GAME—HAPPY JOURNEY TO LOVE

CROSS REFERENCE TO RELATED APPLICATION

This application claims the benefit of U.S. Provisional Patent Application No. 61/563,497 filed on Nov. 23, 2011, the contents of which are incorporated by reference herein.

FIELD OF THE INVENTION

The invention generally relates to a social based trading card game (which may require trading cards and/or playing cards). In an embodiment, the social game is for players who do not know each other (strangers to each other), such as women and men of like or similar age, who meet around a card game table and play by using specially designed cards, designated rules, frames, marks, images on a playing surface, and a card game dealer. In some embodiments, a couple wins by forming a winning or fitting pair of cards and by both agreeing to depart the playing area. Thus, the social game, which may be called HAPPY JOURNEY TO LOVE© or "STREET IN AND POKER IT ALL©, may be played by players in order to find a girlfriend or boyfriend, or lover and/or partner. In some embodiments, game play cards are purchased but there is no betting during the game, and game play is not random. In some implementations, the winning players (a couple) are permitted to take the winning pair cards with them, which may be considered a trophy, or may be sold or entrusted by those winning players to others who may be interested, for later use for example, as trading cards.

BACKGROUND

Trading cards are well-known methods of disbursing and collecting information about public figures. A familiar type of a trading card is the baseball card that has a photographic depiction of an athlete along biographical and statistical information about the athlete. These baseball cards and other cards dealing with various sports figures are used by sports enthusiasts for gathering information about players and teams. Trading cards have also been developed in other areas, such as the entertainment industry, which depict music performers and television and movie personalities. Trading cards are typically exchanged among enthusiasts to obtain cards that are needed to complete a set of related cards or to collect cards that are not really available. Collectors buy and sell these for their economic and historic value, depending on the popularity of the individual depicted thereon and the availability of each card, some being more common than others. Such cards are typically sold through retail game stores and other specialty outlets.

Conventional playing cards on the other hand, especially the well known fifty-two card deck of cards, are easily and readily available. The cards themselves individually and collectively, generally have no value other than for amusement. Many different games can be played with a single deck of playing cards, limited generally by the imagination of the players. Some card games required cards have little value outside the playing of that particular game. Many games played with the more common face cards are games of chance. In other words, these games have rules that require either the random selection of cards or depend on the occurence of events outside the control of the players. Other games that require some strategy usually limit the level of strategy with restrictive rules of play.

Other types of card games use freely tradable game elements or components, such as trading cards, and further such games may enable a player to form an unique combination of components that competes against the combination of other players. The game gives a player the unique ability to modify the effect of other cards as well as the fundamental rules of the play, and it further gives the player the ability to resist such ability on the part of opposing players. Such games pit players against each other in a battle of strategic skills. Such games may further include components that have a tradable and collectable status, though mainly related to the play. In other words, a certain number of game components have a limited availability to the players, thus increasing the value of such components and encouraging players to trade and to collect the game components. Furthermore, such games permit players to construct their own library of components in an effort to obtain a competitive advantage as permitted by the provisions and availability of each component, as well as the player's skill in combining the game components, prior to play. Following the aim of the game the card players have to create their own set of game elements, to compete against the set of game elements of other players. In some cases, the collectability of trading cards with its elements are restricted by the goal to prepare to play the game in a better way.

Accordingly, a need exists for a card game involving at least six players which may be played around a special card game table, wherein players do not play against each other. Instead, the goal is to have two players, who have not met each other beforehand, win together.

SUMMARY OF THE INVENTION

Presented is a card game called "Happy Journey To Love" or "Street In & Poker It All" that is played by two individually acting gender teams (at least in a mental understanding) around a special designed card game table with at least two obviously acting players during a turn of the game, while one of the players is risking an offer for at least one of the other players due a special contending card expecting a positive response directed on the aim of an in common love of at least one of the players around the table. At the same time the offeree is asked to answer the offeror a response; nevertheless at the same time the offeree is possibly waiting for another positive response directed on her/his offer of a common love behind an at least imagined self risked card to be answered at least of one player around the table. The needed cards to contend and to be answered are required to be bought and at the same time each player has to chose his/her own desired cards for his or her created hand. All chosen and bought cards required to be calculated to satisfy an in common imagination about love and good feelings between the offeror and at least the contended offeree. The chosen graphic depictions or painting(s) on the card to be contended or to be answered with a pair card of the contended offeree is the obvious communication during the game.

In addition it is required to play his/her cards in respect for all of the other players around the table and at the same time in a best acted style behind a non verbal communication and flirt to increase the power to convince at least one of the players to enjoy a common love a while and in front of an "expressis verbis" needed pair and win at last. The Happy Journey To Love card game can be played around a conventional card game table with a required game related cloth, a special designed surface and with special configurations around the table of at least three seats for the male gender a side and at least three seats for the female gender at the opposite side. In some embodiments a table for at least eight players, or ten players, or for twelve players is required. At the foot part of each table there must be a card dealer, the so called Table Server and at the head part of the table at least one special swivel chair for short time playing players, the so called "Jumpers" is needed. The Jumpers are offerors, men or women, changing different tables after each turn while in generally the players have to stay with one table for more than one turn as it usually happens in casinos. Just in the case that at least one regular player of all at least six players around a card game table is missed the Jumper is with the right to take a Jumper swivel chair and with a priority to start to contend a special card a special player, though restricted to offer just this one card.

Usually the decision for the priority of a regular player around a table is requiring the rule of a first stretched hand with the needed card(s) in hand and the first seen election of the Table Server, comparable the merchandise of former stock exchanges. The possibility to change the tables after each round opens the chance for the card player to meet more of other players in a fluctuating way though sametime in a short time way while the regular players around the tables are with the chance to meet all of the other at least five players around in a closer way though the fluctuating exchange for other players usually takes time.

The specially designed green cloth for the surface of the game at least contents three parallel printed frames in the seize to put in a regular hand holdable card, while those frames are imprinted in front of each player. Each of those frames is indicated with at least one letter, able to introduce a first function of the field. Beginning with the left frame the capital letter "W" or the capital letters "WELCOME" are printed above the frame or elsewhere around. The mid frame is with the capital letters "SB" or "STAND BY" while the right frame is with the capital letters "P" or "PASS" (meant in a friendly way).

The area around the dealer, the called Table Server, is required to present three frames on the cloth in front of the dealer, frames for three categories of piled up cards to deal in a random and hidden way, while to the left and to the right side of the dealer's chair special sideboards required to present indicated frames for each player next beside to put in a winning pair a while, the while and option for the winning players to absent for a first though last decision to take the win due a small talk usually with the bar of the gaming company. It is required due the rule that no conversation between the players is allowed that sole the dealer and so the players with the dealer are advised to communicate in a predescribed way, efficient comparable different commands with card tables in casinos.

At the begin of the game the players around the table must buy own cards out of a so called "start up deck" of at least fifty five (55) cards, cards with at least eleven (11) different meanings and pictures or graphic designs on the faces, the image categories. During the turn and until the end the Table Server is required to offer at least an one time chance, the so called "second chance", to buy cards in addition, randomly dealt out of a so called "final deck", a deck including Jokers and Wildcards, in front of each Table Server, to exchange not fitting cards or to complete the hand of a player though the chance to earn a Wildcard or Joker is countable and predictable in case of at least two bought hands in exchange.

The Street In & Poker It All cards are of special needed designs at least different images, graphs, numbers, letters, marks, optical illusions and colors are painted on the faces, those images related on different functions and meanings behind each card and sometimes all cards are needing at least special marks, letters, pictures, numbers and graphic depictions and optical illusions on the back of a card. The game is requiring at least six decks of fifty five (55) cards with each start up deck and in addition at least six decks of sixty (60) cards with each final deck, the fifty five (55) cards of the start up deck plus five (5) added Jokers or Wildcards.

All in all the HAPPY JOURNEY TO LOVE or STREET IN & POKER IT ALL card game needs start up decks and final decks for at least three different value categories, the different values of the cards to buy. In some embodiments it is ruled that at least two (2) to maximum five (5) cards in hand are required for a regular turn. The method to play with just one card in hand at the begin is required to build the exception of the game. It has been found that the chance to play and to win sole with one card in hand from the begin, the one card a win strategy, is increasing the tension and motivation of spectators and the tendency of players to quickly answer a win due the expression that the offeror is showing that he or she doesn't want to flirt and to attract other players to succeed. Also a contended player can use that strategy to prove same intentions from the begin.

On the other hand it has been found that in case of strange intentions to cheat the system due organised couples at least two cards in hand are needed for a regular begin otherwise the not intended risk to break the bank appears. The first win of the game is to earn the doubled amount of the winning pair cards' value. Therefore all players and spectators are just with extraordinary chances to earn a special card that allows to start up a game sole with that one card a win strategy.

In some embodiments maximum two extraordinary chances to win the game with a called one card a win strategy are offered. First, the case after a win situation and the offer not just to earn the pure money for the doubled amount of the winning pair cards' value, and so to allow to take at least one of the winning pair cards with, instead of the related money. Regulary all cards have to be returned so that just that specially bought cards can build a next time chance to bring at least one card with and so to begin with that one card in hand. The so bought trading card can also be used for collecting or for selling methods or to give it special beneficiaries to visit the game or to sell or to collect the card(s), too.

The second extraordinary chance build the case of special gratifications during a day of the HAPPY JOURNEY TO LOVE or STREET IN & POKER IT ALL game, the free give of so called ANGEL'S GOLD (for females) or BIT'S GOLD cards (for males) to visitors and spectators several times the day builds the chance for potential players to start up the game sole with that free golden card in hand with an one card a win strategy. It is a consequence of the game that in the case of a winning pair or in the case of a full loss of all cards without the will to buy other cards the amount of players around the table is decreasing immediately due a go & leave necessity. This method opens a needed fluctuation of new and unknown players at least with each win of the game cause it is not allowed to go on with the HAPPY JOURNEY TO LOVE or with the STREET IN & POKER IT ALL game in case of a winning pair and at least for that day.

For all of the other remaining players around the table (for 6 players, for 8 players, for 10 players, for 12 players) it is allowed to go on with the game in a reduced amount of players for an intermediate time, if at least four (4) players are playing around the table. In all of other cases of less than four players around the table it is requiring at least a Table Server's time out until a Jumper or another player can fulfill the needed amount of four (4) players. It has been found that the fluctuation and the amount of at least four (4) players around the table is needed for the motivation to risk a card to contend a player, therefore the special free cards, the "ANGEL'S GOLD" or BIT'S GOLD cards are required to fill up the seats around the tables for the needed amount. Beneficiaries of those cards are advised to use them within a maximum of at least a quarter of an hour due the print of an expiration time on the face of that card.

It has to be respected that in case of losing all of other cards except the last card in hand just seemingly an one card (in hand) a win strategy is given though just in case of a new player around the table not knowing about the former hand of that player.

The HAPPY JOURNEY TO LOVE or the STREET IN & POKER IT ALL game requires different values of cards at least visible due a special color. It has been seen as a need to offer same cards but with different values. In the all begin the Table Server is required to explain the main rules and to hand over a start up deck each new player (a player with no cards in hand) to chose his desired cards in hand. The HAPPY JOURNEY TO LOVE or the STREET IN AND POKER IT ALL special painted face cards are reproduced to be able to warrant at least the three required different values, the three value categories of all cards to be chosen and to be bought out of a start up deck by each player. As a first playing decision, depending on the players' tactic for the game, each player has to chose a visible value category for the card(s) in hand. The Table Server is required to offer the choice for the right value of cards in hand at the begin, after that decision the start up deck of a chosen value category in a related color is needed to be handed in a decent box to enable the player to discretely decide for his or her particular cards in hand to start up and at the same time to discretely put in the needed money for the chosen cards, thereafter the decent box has to be returned with all not needed cards and with the money for the chosen cards.

It has been seen as an advantage to split the prices for each value category for the cards depending on at least two different categories of tables for two different categories of players (youth and older people). At least tables for very young players (18 to 25) or for adult players (26 and more) are offered to play the game in a separated way, the table for youth at least with cards of 2.00 USD/EUR and the table for adults at least with cards of 20.00 USD/EUR related the lowest value category. Of course it is allowed for older players to take the table of the youth though it is not allowed to take the other way round. In particular to convince at least one desired lover and offeree due a color visible value category of cards remains the decision and tactic of each player, sometimes a more is needed and sometimes a less is better. Also the amount of chosen and bought cards in hand remains the exclusive decision of each player.

Nevertheless it has been experienced a benefit that the Table Server is required to offer an option, the special developed and own calculated HAPPY JOURNEY TO LOVE oracle voice based on an eight questions including poll to suggest the optimized amount of cards to buy. Due that open to handle poll and conversation about main opinions directed on love and couples this exception of the silent play can build the unique chance to introduce the player's character a bit at least in a tactical understanding and in front of all players around the table. The Table Server is asked to lead the questionnaire and to evaluate the given answers to at least suggest an optimized amount of cards in hand able to increase the power to win in respect for the invented system behind the HAPPY JOURNEY TO LOVE or STREET IN & POKER IT ALL game at all.

As on all cards required own created designs in principle, at least graphs, marks, pictures, paintings, words, letters, numbers and optical illusions are needed to create methods for the game in addition with rules for the game as other impacts to increase the power in front a winning process, further requiring the configuration of a specially marked card game table, a specially designed cloth with first rules on it, a dealing Table Server, artfully calculated designs on each card, money/tokens to buy cards, a secret niche for an optional given first small talk for closer eyes between the players, methods to play the game in a card&player combining way to fuse trading cards with playing cards at least in an independently given way, methods to fuse two opinions and desires directed on the aim of the game at least to spend a well feeling time together.

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

Like numbers in the drawings indicate like elements.

DETAILED DESCRIPTION

Figure 1:
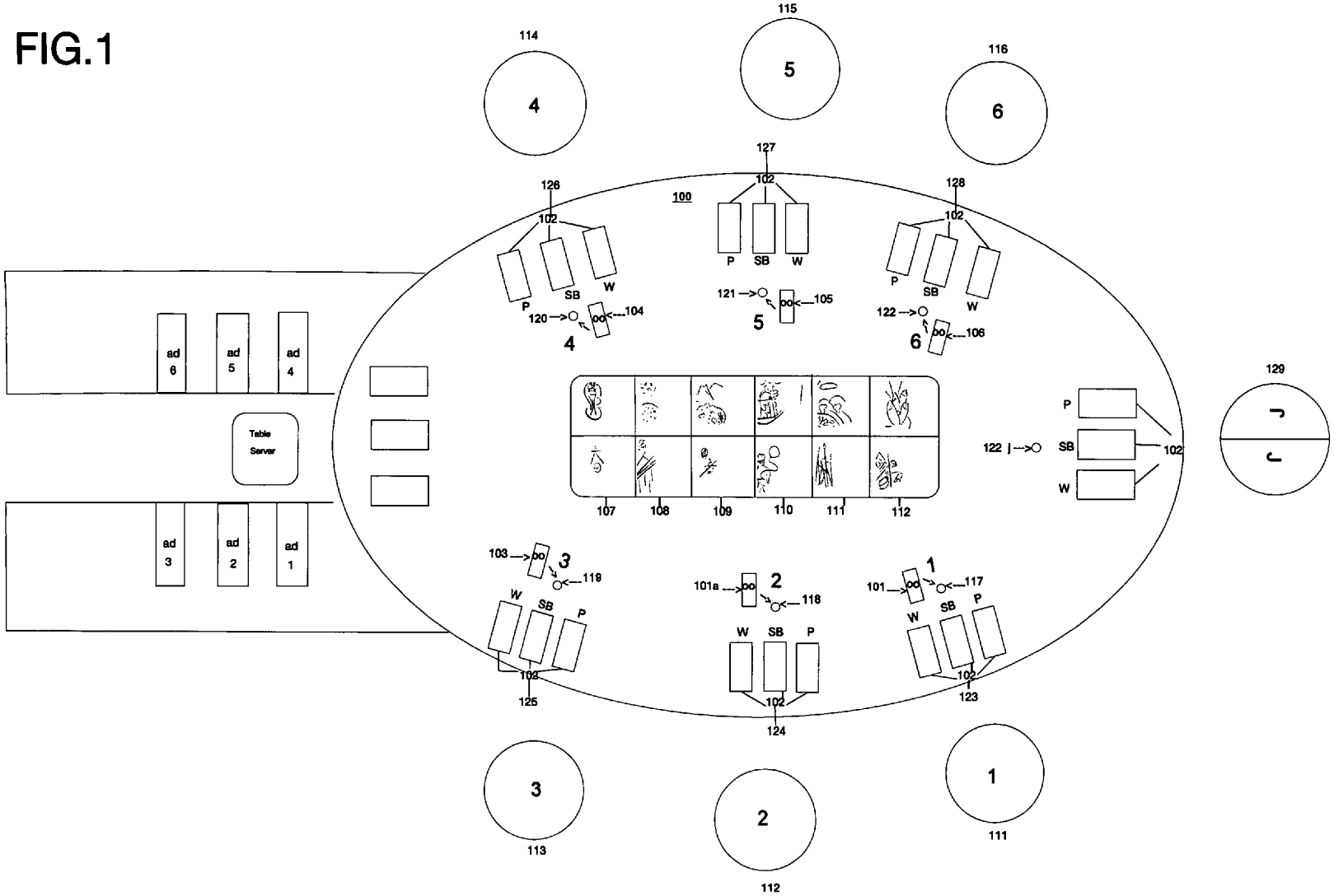
FIG. 1 illustrates a card game table including a cloth, not drawn to scale, which also illustrates the players' and the Table Server's area and seats with frames and designs on the cloth according to an embodiment of the invention.

The basic game play involves a Table Server or dealer of specially designed playing cards and rules that include no oral communications between players while play is in progress across the gaming table. In some embodiments, the dealer directs play and can talk to each player. The dealer may be employed by an organization, such as a Casino company, and sells the specially designed cards to players before the start of play. The dealer or Table Server also handles the rules of the HAPPY JOURNEY TO LOVE© card game, which can be compared to poker in that players can bluff and/or utilize other non-verbal forms of communication in an attempt to influence another player who is a target as a potential partner. In some embodiments, there are six players, three of each gender who may sit across a playing table from each other.

The game begins with the dealer providing cards to each player (up to five). The dealer offers three different values behind each card of a particular deck, and in some embodiments there are three decks, wherein each deck includes the same type of cards but cards of each deck cost a different amount. For example, the first deck may contain cards that cost two (2) dollars each, the second deck may contain cards that cost five (5) dollars each, and the third deck may contain cards that cost ten (10) dollars each. The decision by each player to buy cards from any of the particular decks is important at the beginning of each turn because of strategy concerns regarding preparations for winning the game. For example, some players may not wish to attempt to win with another player who is utilizing the 10 dollar cards in their hand. It should be understood that, in some embodiments, a player can only purchase cards of just one of the values per hand for all cards for that turn. Players must also decide how many cards they should purchase for that hand (for example, should a player buy four cards of the 10 dollar denomination or five cards of the 2 dollar denomination, or two cards of the 5 dollar denomination. Such a decision may be based on the other players seated at the game table; for example a single male in his mid-twenties may purchase more expensive cards because the single ladies at that table are rich attractive).

Thus, the dealer (the Table Server) offers an option or suggestion to each player, if the player requests it, regarding what may be the correct amount of cards for that player to have in hand (wherein the denomination or price of each card remains the decision of each player). This option may be considered as part of the "oracle voice" duties or responsibilities of the Table Server to guide game play. For example, the Table Server may take an open poll (in front of all the players and loud and clear verbally expressed) by asking a series of questions of a particular player which serve to introduce that particular player (player who takes the option) in front all of the other players. In some cases, this can be an advantage but in other cases it may be a disadvantage. For example, sometimes the secret character behind a particular player can be beneficial later in the game because in some embodiments the player may be required to answer eight questions (explained below) that are necessary to win the game.

Figure 10:
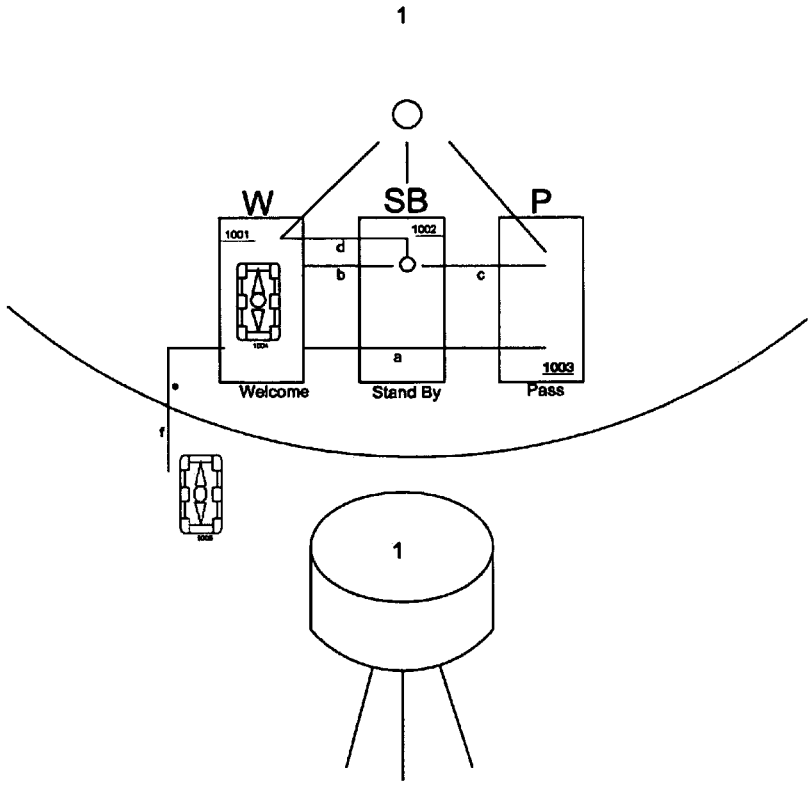
FIG. 10 is an enlarged top view of the surface of a HAPPY JOURNEY TO LOVE or STREET IN & POKER IT ALL cards game table, not drawn to scale, to illustrate a player's choice to handle an offered face down card on the cloth, according to an aspect of the invention.

In some embodiments, after each player has purchased cards and is ready to play, the Table Server begins the turn by ringing a bell (which can be a small jingle-type bell) in front of his or her position. The players may then be required to stretch their arms and hands upwards so that the dealer can decide which player to select as the first allowed to offer an unique chosen (and so designed) card to another player (for example, a male player may decide to offer and/or to contend a card to a female player seated across the playing table or playing surface). The dealer is then asked to lay down that particular card (first face-down) in front of the female player (as shown face-up in FIG. 1 with 101). That moment of an offer and card placed face-down is an expressed wish by the male player to spend a good feeling time together with the offered female player, who is the offeree. Next in FIG. 1, the female player (the offeree) utilizes frames 102 on the playing surface 100 of the game table, to make a first decision and move of the played card, which communicates how she would like to continue with that male player who played that card and made the particular offer. In some embodiments, different conceptions for the indicia (as functionally shown in FIG. 3 symbols 301, 302, 303 on the back of a particular playing card) can fit or match that of the female player, and perhaps she will take a closer look at the offeror and begin the play with movement of his card (as shown in FIG. 10) to a WELCOME 1001 field or to a STAND BY 1002 field on the playing surface. If not, the female player may instead decide for an early drop out due and move his played card to a PASS 1003 field on the playing surface. In some embodiments, it is the Table Server that physically moves the card to one of the fields at the request of a player. In some cases, the female player (offeree) may wish to know more about the face of the offered card (and in that way of the face of the male player/offeror because the male player decided to play that card with that unique face 401 (examplary illustrated in FIG. 4), wherein the face on the card may express or convey, for example, an erotic message or relate to a hobby, or pertain to a fashion). In such a case, the female player can lead the card to the WELCOME field (1001 in FIG. 10 and in this field the card may be turned face-up). The WELCOME field can be utilized to win the card game if, in this example, the female player places the same and/or corresponding pair card. However, if the played card is on a WELCOME field and still in a face-down position, she can take some time for a closer look at the back of the particular card because there may be different indicia on the back, and a rule may be used that the female player or offeree is given the chance to guess about a good feeling and about a fitting player behind that card and face. However, such a play is not enough to win, even in a case of an early decision to do so because the female player still needs to have the same face card of the played card in her hand, otherwise she would be asked to buy another card. So therefore some female players or offerees would base their decision on the fact of a fitting card in their hand but due to the cryptic symbols on the back just a guess about that fact can be given in principle (an exception, in some embodiments, is a case where the color fitting PAIR SYMBOLS (PS in FIG. 3) located on the back of the card, which would be rare because then the female player or offeree would know if there is a matching card in her own hand. Accordingly, depending on that knowledge, as shown in FIG. 11, she can decide whether or not to lead the played card to the WELCOME field 1101, and after the closer look at the back of the offered card, it may be moved to the STAND BY field 1102 (with the meaning to wait a while; the female player desires to continue play with other players in the meantime and wants to go on with the STAND BY card later), or it may be moved to the PASS field 1103 (with the meaning of a drop out and a loss of that card for the offeror).

Figure 11:
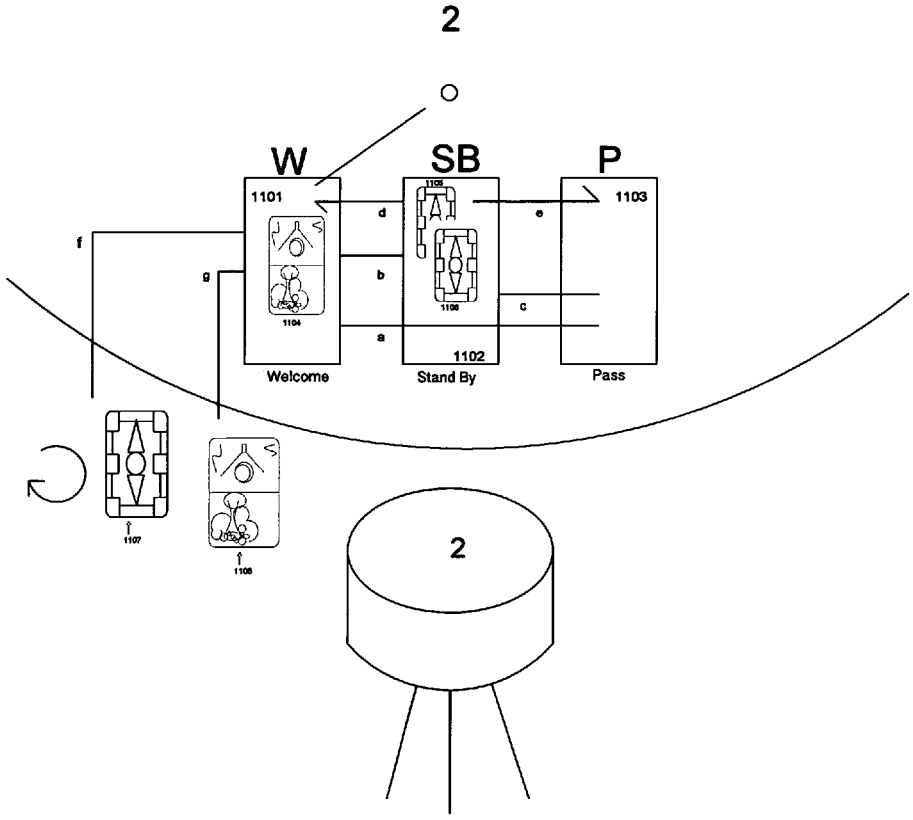
FIG. 11 is an enlarged top View of the surface of the card game table, not drawn to scale, to illustrate the closer area in front of a particular player showing one strategical variant of the progressed turn; two face down cards behind on the mid frame, the SB—STAND BY frame, and one face up card midst the left frame, the W—WELCOME frame.

However, if the female player knows about a fitting card in her hand or would like to take the risk of buying another card (with the second chance deal), she would like to see the face of the played card and so would like the dealer to turn the played card face-up 1104 (as shown in FIG. 11). But turning the played card face-up on the WELCOME field comes with a special price (due to the intimate disclosure of a player's face and a possible erotic nature of the card). With the order to turn the card face-up, the female player or offeree is obliged to place down the fitting pair card 1108 (the same face on a card that is in her hand) as a first proof directed to her ability to win the game with that male player. If the female player does not have a fitting card, then she has the right to buy another card or a lot of other cards in the second chance deal so as to be able to provide a pair card. In the good luck second chance deal case she will lay down the fitting card, but that in itself is not enough to win. In such a case, the dealer (who is not interested in a too early win of the players) will doubt that this is the right decision of the offeree or female player and will advise them to have a look around at all of the other players and spectators (who may be waiting to play). In some embodiments, the dealer may then decree that the female player take a "time out" to prove that she has chosen the correct male player that may be for a period of ten minutes that can be utilized for a first small talk between the male player (offeror) and the female player (offeree). In that way the offeree can find out if there are more similarities due to that conversation (for example, those two players may leave the playing area and go to a bar and have a drink together). So after that option is taken (or maybe before and without that option) the woman/offeree will come back in time with the male player (offeror) and will affirm the common will or desire of both of them to spend time together (such as dating) and that would build or seal the win.

In the case wherein the female player does not obtain a matching or fitting card during the second chance deal, or in the case where the male and female player do not reach a common understanding after the "time out" period expires, then the female player can decide not to take the offer (she has to do so in principle in case of no fitting card in hand) and so loses this turn with that male player. But due to her curiosity she has possibly seen the face of the male player and she must then also lose a card, which may be the pair card on the playing surface that she played or a card she chooses from her hand. Due to the risk of losing a card, and perhaps due to other reasons, the female player or offeree may decide to ask the dealer to move the card 1104 to the STAND BY field 1102 in FIG. 11 (and in some embodiments the card 1105 remains face-down, but it is contemplated that there may be cases in which that played card may be turned face-up when moved to the STAND BY field). Such a decision serves to buy time to continue play so that the female player may have a chance to make an offer or receive an offer from a different male player, for example, or to take a break during the turn(s) of other players so that the female player can later decide whether she wishes to have the played card 1105 that is now on the STAND BY field 1102 moved to the WELCOME 1101 and turned face-up in an attempt to win with that male player.

Accordingly, the game play varies as a played or offered card is moved between the three fields, (a)+(b)+(c)+(d)+(e) moves. Of course, it is contemplate that more of such fields on the playing surface or cloth can be developed. It should be noted that when an offeree moves a played card to the PASS field 1103, that does not always have a negative connotation or dissenting opinion, but may instead just mean that the offeree wishes to wait for a second offer of the same player. But in some embodiments, the WELCOME field 1101 is utilized as the "face-up field" and the winning field. In addition, in some implementations, it is not within the ethics of the game rules for a particular player to collect too many cards on the STAND BY field 1102, and in some cases only two cards 1105, 1106 are allowed or perhaps up to ten cards are allowed on that field. If too many cards are collected on the STAND BY field, then some special rules may be applied by the dealer for that player to advance the game.

Thus, the above described game play fits the potential of each player's selected cards and requires individuals to express their behaviour in a positive manner while playing the cards of the game to convince at least one unkown player (typically of the opposite sex) to believe that they can share some good times in the future after the winning the game. Thus, the players are required to fuse different meanings or interpretations of specially designed cards in such a way that a particular pairing means good feelings and good expectations for the two player(s) to play strategically while the dealer enforces the rule of no verbal communication between the players. The HAPPY JOURNEY TO LOVE© card game thus offers different people and different unknown players (strangers to each other) sitting around a game table the chance to flirt, to meet and/or to attract a girlfriend or boyfriend with each turn a game. The win situation can be seen as a form of a nascent melting of hearts, or other positive feelings directed from the players (offeror and offeree) to each other by using different strategies and following different rules to handle the offered card on the game table surface. During such game play, all of the other players seated at the game play table are in a silent stand by play mode and do not act with their cards in any obvious manner. The present card game also combines playing cards and trading cards at the same time with the special need that in case of a won pair, those trading cards are not necessarily collected just due to the playing of the game. Such collected cards that are artfully designed with different pictures on their faces (in the meaning of a special love) may increase in value enormously depending on the long time success of the pair (and maybe of the couple), and meanwhile new designs and pictures may be produced on comparable cards behind comparable pairs, which may replace those no longer used.

The social card game forces all players to identify their personalities through play of their trading and playing cards as they try to win the game. The consequence of an confirmed pair by the dealer (and thus of the players' win situation) may result, in some embodiments, in the couple earning money that is double the amount of the value of the winning pair of cards. The entity running the HAPPY JOURNEY TO LOVE© card game, through the dealer, may make such a payout, and in some cases the winning cards themselves may become the property of the winning couple to take with them, which can be kept as a keepsake or trophy, or sold to others. In some implementations, as a special surprise each winning pair may earn an envelope that includes different vouchers for products or services, for example, movie tickets, concert tickets, hotel suite vouchers, candle light dinner vouchers and the like, which may depend on advertising revenue agreements of related companies that sponsor the game.

FIG. 1 shows an embodiment of a top view of the HAPPY JOURNEY TO LOVE© card game play area 100, or card game table, or playing surface cloth. (In some embodiments, the game may also be called STREET IN & POKER IT ALL©.) The game play area 100 is not drawn to scale, and may include a cloth with depictions of the faces of different exemplary imprinted playing cards 107-112, enlarged on the surface, which in some implementations are along a mid stripe of the table. The cloth may further include different special frames to set in special playing cards, hand-holdable in front of each player and in front of the dealer or Table Server. As illustrated in FIG. 1 around that table different seats 111-116 are prepared for the players who should be strangers or unknown to each other. Each playing position is marked with a number (1 to 6) on the cloth and in front of the particular player. The hand holdable playing cards (and trading cards) are offered each player in a face-up way and as stylized illustrated 101-106 on the cloth within a defined place in front of the player and in front of the relating number (1 to 6) and mark 117-122(*j*) for each player.

In some embodiments, five (5) cards, grouped as Feel Well™ cards are needed for a legal hand, while fifty five (55) regular cards are in a deck. The 55 regular cards may include eleven (11) different categories of face card images, the eleven (11) image categories each including five (5) cards. At last the faces on the cards of the pair and the well feeling imagination behind at least these two players builds the win and all of the other methods to reach the aim are related on the especially painted pair faces 401, 402, 403 (exemplary shown in FIG. 4).

The enlarged six (6) of usually eleven (11) different face up cards 107-112, printed on the cloth 100, e.g in FIG. 1, exemplary seen as an introduction of some face cards, illustrate graphic designs of twelve (12) in particulary different (here stylized) images, the two mirrored pictures on the face of each card, while those two graphic depictions on each card are intended to reason at least one and the same imagination between at least two particular players (the offeror and the offeree). This imagination behind a played face-up card should bear a needed well feeling to go on with the game. In some embodiments the two different graphic depictions on each face of a card are required to illustrate at least different erotic pictures, paintings or written designs, optical illusions or other graphic depiction to produce a good feeling at least for two players of a turn. It is the chosen face of a card and the individual face of the player is the main impact to convince another player to win together due to a proved pair card on the cloth of the table.

In some embodiments only one graphic depiction is illustrated on an entire face of a card, or different pictures on several cards in whole or each whole painting on all cards to reason at least a touch of an erotic imagination or to show another image for another good feeling. This is directed to the aim of the game to find an in-common opinion at least to have a good time together and maybe to be a couple for a while. In some embodiments at least six (6) regular players (see seats) 111-116, women and men, are required to play and meet around the card game table (FIG. 1) to start up the social card game, but in some implementations it may be permissible to start the card game with as few as four (4) players around the table.

Figure 2:
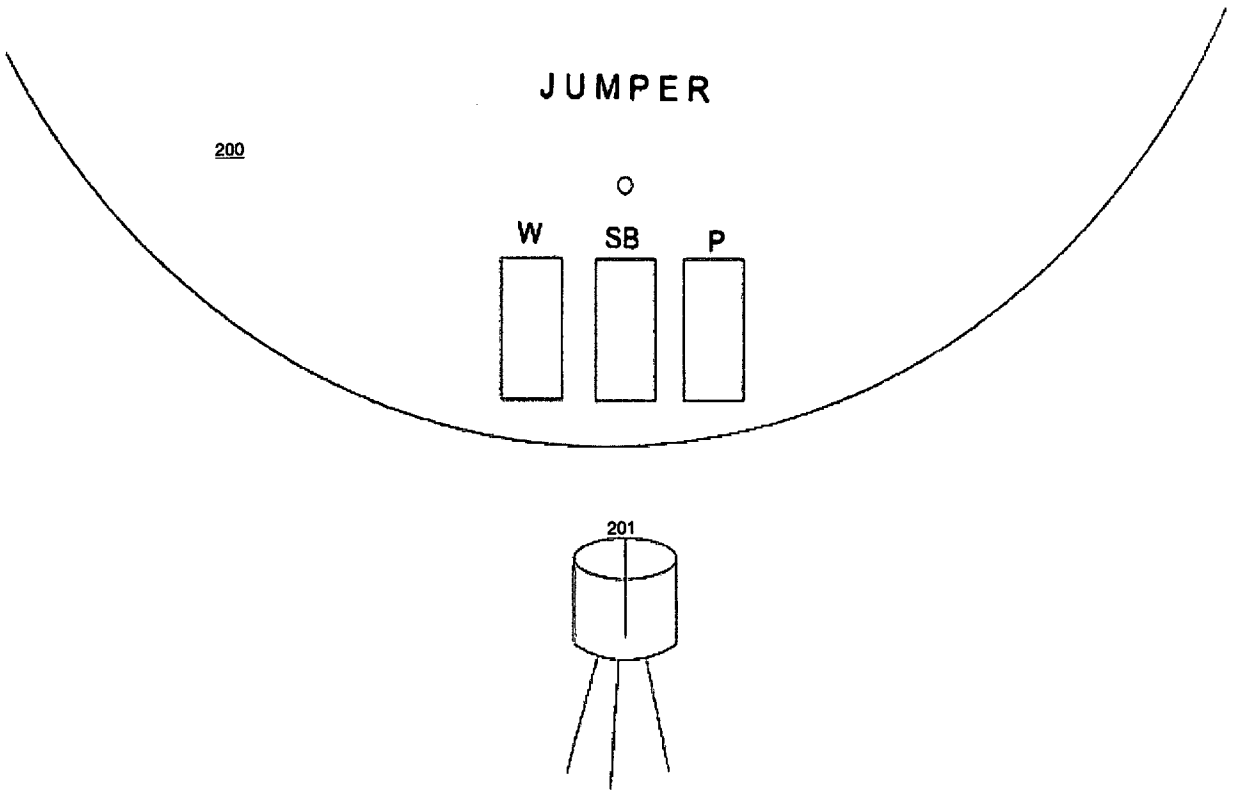
FIG. 2 illustrates the special "swivel chair" around the table for the short time players, the "Jumpers", not drawn to scale, according to an embodiment of the invention.

As illustrated in FIG. 1 at least one of the three players 111-113 at one side the table, usually a man, is playing with at least one of three other players 114-116 (usually all women) located on the opposite side of the table, which may be an oval table (although other shapes and sizes of table could be utilized). At the foot of the table is the Table Server or dealer who deals the cards, while at the head of the table 200 (detailed shown in FIG. 2) may be an optional swivel chair 201 that is prepared for short time players, known as "Jumpers" who may be short-time players. For example, if one player is missing from the game table, a Jumper (wherein the Jumper is not a regular player) may be able to take the seat with the swivel chair 201 (which may be colored blue and at the same time pink) and at the same time he or she may have the prior right to start up a turn after the recent round. Jumpers have the sole right to play one turn at one table in a successive understanding to utilize different tables.

The regular players and the Jumper(s) around a table are required to remain silent and not to verbally communicate to other players. Only non-verbal communications between the players is allowed. Verbal communication or conversations between any one player and the Table Server or dealer is allowed and is needed to efficiently play the game, but the players are required to respect the lead and/or judgement of the Table Server (as players respect Casino dealers). In addition to that method all visually presented impacts of the offeror, or of other players or spectators, are needed to increase the power to convince at least one contended player, the called offeree, to decide to lay down a pair card and at least for a love in the understanding of the game. In some embodiments, the first turn of the game starts up with at least one self-chosen card in a stretched out or raised hand, which each player plans to offer the face of that card to another player. The playing card represents one chosen graphic depiction of an image category on a front face (see FIG. 4) to be presented to at least one other player, usually of the opposite sex, optionally in a face-down manner. The so offered card is needed to be moved/placed in front of a player on one of the illustrated three frames on the cloth of the card game table and in front of the elected offeree(s). It is the method to combine a card game with game and win influencing functions also due its fields on the cloth, sometimes a turn is utilized like in a boardgame.

As illustrated in FIG. 1 the mark of a small white circle 117-122(*j*) in front of the three frames 123-128, below the particular number (1 to 6) for the player, in detail in front of the mid frame, shows the Table Server where to place the contended or offered card(s) in front of the selected player(s) (offeree(s)). In the case of different offerors risking to offer a card to another player or other offerees at the same time, it is the Table Server who decides about the priority of play, and so decides which player starts a turn. It is allowed for each player to communicate to the Table Server and the other way around though solely in a specific way to respect the formal lead and/or directions of the game by the Table Server. Consequently the Table Server is asked to place the self chosen card(s) of his/her elected offeror(s) on the table surface or cloth in front of the chosen offeree(s), and specifically in front of one of his or her frames on the table surface as marked through a small circle. It is intended that the play of the cards combined with the table surface markings and the Table Server are needed at the same time to succeed with the game, while the apparatus is requiring all of other rules and methods as described herein.

In some embodiments the three frames 123-128 in FIG. 1 are shortly described at least through three different letters and words. The left frame is marked with a "W" above or around the frame and with a relating "WELCOME" below, while the mid frame is marked due the letters "SB" above or around the frame and with the words "STAND BY" below, and the third frame is marked through a capital letter "P" above or around the frame and with the word "PASS" below it. It is the first decision for the offeree to answer the offered card through a lead of that card by the dealer to the middle of one of the three frames on the playing surface or cloth 100. The offeree may indicate where the card is to be placed by moving a forefinger or directly asking the dealer to do so. Due to the clear meaning of the written marks (W—SB—P) for the frames, the offeror and the offeree has a fairly good first guess about the meaning behind each frame. It is intended to adapt the illustrated cloth in a detailed way, so different other marks should assist each player to find out about all rules behind each frame and mark on the cloth in case of completely uninformed players. It is the fact that even the act and move on the cloth, that is to lead the dealer to place a card onto the SB or "STAND BY" field/frame or from a SB—STAND BY field to a "WELCOME" field or the other way round, influences the card game and the win situation (for example, maybe a player will consider that since his card is on the STAND BY frame that now it may be best not to proceed with the second choice play because that player no longer wants to win the game with that offeree anymore). Referring again to FIG. 1, all of the offered six (6) regular face up cards (not enlarged and) in front of the frames of all regular players, on the marks 117-122(*j*) (the Jumper 129 is with no card on the mark 122(*j*) in front of his/her frames), illustrate an early act for the play through an extreme "All Six Cards" (in hand) wherein all players offered cards and strategy to reach the aim of the game (though in deviation to some of the main embodiments). Just one card is required to be offered at the same time, while in principle a particular hand of each player allows up to five cards, regularly at first a face down card is communicated and offered and the Jumper is just with the right to play in case of a missed regular player around the table.

In particular and as illustrated at least the face up card 101 in front of e.g. the player with the number one (1) shows the offeror's (here the Jumper's) intention to attract and to contend at least another player, the called offeree (here in FIG. 1 all players), a man or a woman, at least to plead for the offeree's will to go on with that special card in a positive way. Now the particular offeror is waiting for the answer of his/her offeree and is asked to non-verbally communicate and/or flirt with the offeree to earn the right answer for his/her offered card. The offeree is asked to decide for a lead of that card at least to the hoped for W—WELCOME or to the SB—STAND BY field, though it can be a building tactic of the game to also hope for a lead to the P—PASS field, which may occur when more than one card is in hand (sometimes special offerees, women or men, have a positive meaning behind a first lead of a card to the P—PASS field while waiting for another, and so for a second card of the same offeror and meant not to give up immediately).

Due to the completely unknown personality behind the offeror and behind the offeree, there may be many different reasons and impacts, nearly almost all being game intended, which are required to be put in perspective and will influence the further decisions of the offeree to go on with the contended card in a positive way or in an early drop out manner. In some embodiments it is ruled to start up with a face down card as a first offer to go on with that hidden card in front of the three frames on the mark 117-122(*j*) of the offeree, though it is easier to find out more about the offeror in front an open face of at least one card. The face up of a face down card builds one of the main convincing moments in all embodiments. It builds the unique method of the game to play with a hidden, face down card a while, with the meaning of a secret blind date situation behind.

Despite the circumstance that truly the character and/or the flirting behavior of each player (unknown for each other) build(s) the main impact to reach the aim of the game, different methods, different chances, card related effects, card table (cloth) related ways and rules, the Table Server needed assistance and the whole situation behind all waiting players and spectators around the table are needed to influence the given options for each contended offeree to handle and answer the risked card of her/his offeror and to reach the aim of the game. It is part of the game that usually all players and in particular at least two players, the offeror and the offeree, have their own strategy to reach the silent aim of the game though both players not always calculating to go on with the recent player and nevertheless playing the turn with him/her in a very serious way, the special HAPPY JOURNEY TO LOVE or STREET IN & POKER IT ALL bluff method.

The bluff method requires offering one card to an offeree though it is not intended to go on with that particular player, and moreover to attract another potential player due to the bluff. The risk is that the offeror could win with the wrong player due to the fact that, with one exception, the offeree has the sole right to decide about the win or about the loss of the game. For example, in the case of a fitting pair card in hand of the offeree and in case of an immediately proved confirmation of the will to take the pair (the quick decision) the offeror is not with the right to dissent due to a protest that he or she did not really mean to win with that offeree. The rule of the Table Server to advise that an offer and so a first legal promise can't be overruled due to a refusal expression thereafter (the protestatio facto contraria non valet rule). Also the offeree is within her or his rights to utilize the bluff method of the game though then she/he can decide for a loss of the offeror's card until the end. The exception for the offeror to be able to succeed with his bluff in case of a shown first will of the offeree to take the win is requiring the offeree's taken option for a last Time Out, which may be called the Table Server Stand By rule. This rule allows the offeree and offeror to leave the game table for maximum of ten (10) minutes for a first small talk and given to earn a deeper understanding for both of the players. In this case and due the action of the offeror, he or she has the chance that the offeree will not find a deeper understanding for the offeror and will most probably then refuse to take the win and pair, although it is still up to the offeree to decide about and to consent to a winning pair or not, at least in the monetary understanding of the game.

At least it is the individually needed decision to go on with a special card or with a special player in a ruled way. In each case of a first decision and answer of the offeree, e.g. the lead to the WELCOME or to the STAND BY or to the PASS frame, the offeror is with a first glimpse of a deeper answer, given due a first WELCOME feeling, or due to a first STAND BY feeling, or due to an early decision for a friendly meant PASS feeling. Depending on the particular decision of the offeree, the Table Server may be asked to assist with the next step and rule for the game.

Despite that all it is the face (e.g. as stylized in FIG. 4) of the individually chosen card with its unique design that is mainly created to cause a needed harmony to attract the offeree to answer a pair and a kind of love at last. At least the face of a Feel Well™ card is required to present individual likes for an erotic design or a friendship design, or a child's toy design (for a children's version of the HAPPY JOURNEY TO LOVE game), hobby designs, or a design of special interests or designs for fashions or for items or similar, that is proving and communicating a given imagination about a good feeling between at least two players.

The method to offer a self chosen card, sometimes a face down card at the beginning of play can increase the tension and curiosity of the offeree to answer that player a positive rule of the game, primarily shown through the first card move on the table surface and its specific order for the Table Server to forward the card, for example to the WELCOME field.

In some embodiments, the rule is to offer a card face-down in the beginning of the game, and until its face-up later. Therefore the back of a Feel Well™ card requires at least different indicia on the back, able to present a first image and a first guess about the face of that card and about the face of that player behind the card. Each player is asked to decide for his or her particular hand and to choose the right face card(s) out of a called start up deck, usually a new, unshuffled and complete deck, including at least fifty five (55) cards. In some embodiments just one time a turn each player (usually the offeree) has the extraordinary option, the second chance option, to buy another card(s) to exchange their own chosen card(s) or to complete a hand. In that case the Table Server is asked to deal the needed card(s) out of a prepared final deck, usually a shuffled and complete deck, including at least sixty (60) cards. The amount of cards in hand generally depends on the decision of each player, though the rule in principle is that two (2) and up to five (5) cards are needed for a legal hand of the game.

In some embodiments more or less than fifty five (55) or more or less than sixty (60) cards are needed for a start up or for a final deck while more or less cards are required for a legal hand. Other ways to buy cards are contemplated, for example to buy cards in addition out of the remaining start up deck or all of other imaginable combinations behind.

Figure 7:
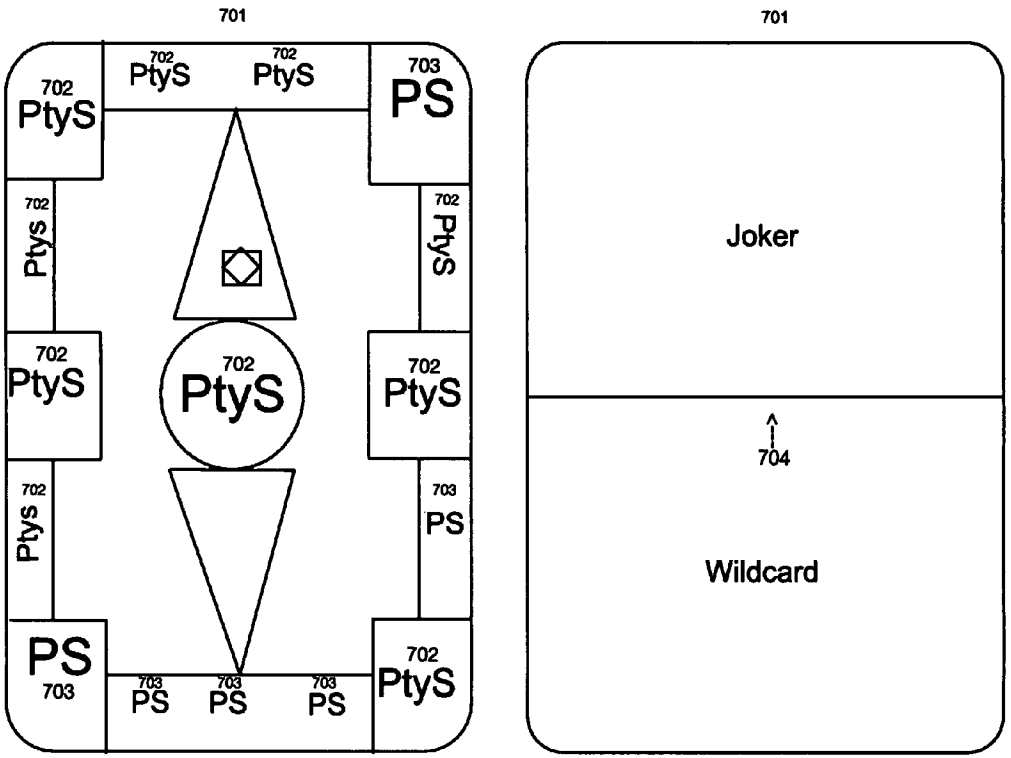
FIG. 7 illustrates at least the two sides, the back and the face, of one Joker or Wildcard, acccording to an aspect of the invention.
Figure 12:
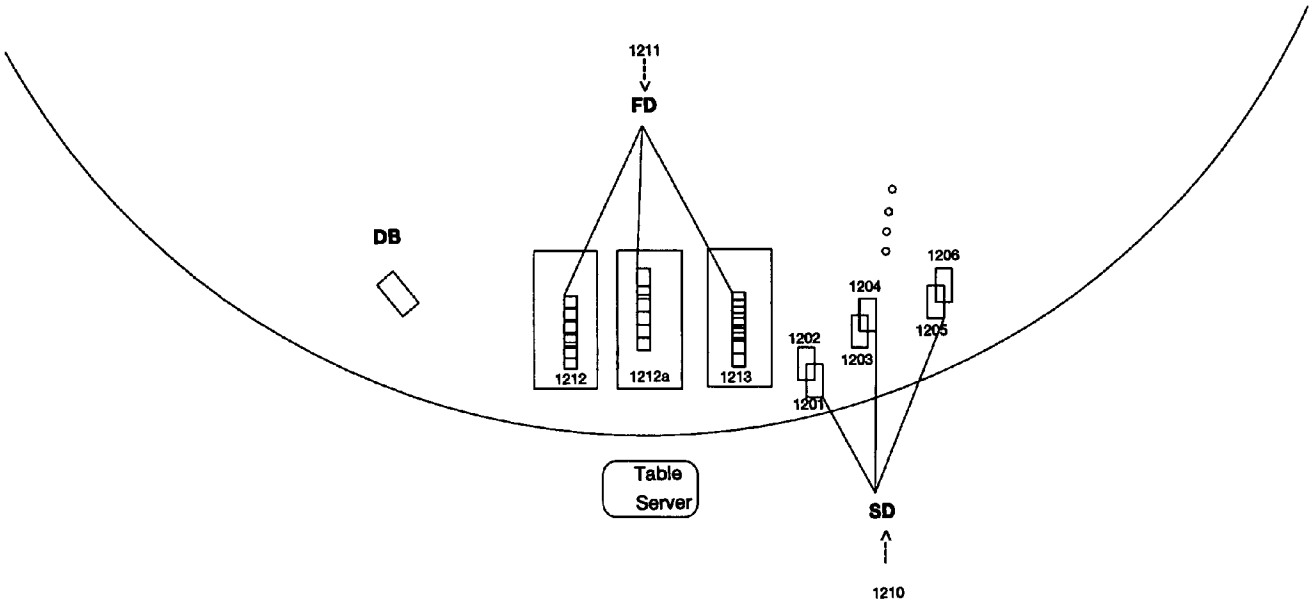
FIG. 12 is an enlarged top view of a part of the cloth in front of the Table Server illustrates three frames for stacks of different final decks, decks of three value categories.

In some embodiments and as shown in FIG. 12, the HAPPY JOURNEY TO LOVE or THE STREET IN & POKER IT ALL game requires at least two different decks, the start up deck 1210 for the beginning of the game and the final deck 1211 for the rest of the turn or game. The start up deck includes at least fifty five (55) cards while the final deck includes at least sixty (60) cards, the fifty five (55) reproduced cards of the start up deck plus in addition five (5) special cards, the Jokers or Wildcards 701 (as illustrated in FIG. 7) which can be used to answer each card of the game the right pair card due to a Joker or a Wildcard. As illustrated in FIG. 7 the Wildcards or the Jokers 701 are cards with special marks and indicia 701-703 (usually with all indicia of all back faces) on the back, printed along the border frame of a back face, while the front face of the Joker or Wildcard may be painted with a special star in world at least in a caricatured style or is presented as a plain white with a horizontal black line in the middle 704. Due to the use of an exclusively black and white image these cards are easy to identify as special Jokercards or Wildcards due their faces. In some embodiments, however, the Joker or Wildcard is not easy to identify in comparison to a regular card due its nearly identical back face, at least for all of the other players around the card game table, except for the particular player who has the Joker in his hand.

In some embodiments the start up decks with fifty five (55) cards are related to a card game table for six (6) players; as shown in FIG. 12 for each player three different start up decks 1201-1206 (doubled examples) are prepared to be dealt depending on the chosen value category, at least one of three value categories are needed to be offered. In such manner each new player (a player with no cards in hand) is with the right to chose his card(s) out of a complete and unshuffled start up deck. At least six start up decks with six (6) times the fifty five (55) regular cards, three hundred thirty (330) cards in all, are needed for the beginning of game play, though counted on the three (3) value categories three times the six (6) decks of fifty five (55) cards, at all nine hundred and ninety (990) cards are needed. To better handle the deals, a doubled amount of one thousand nine hundred and eighty (1980) cards may be needed.

Figure 8:
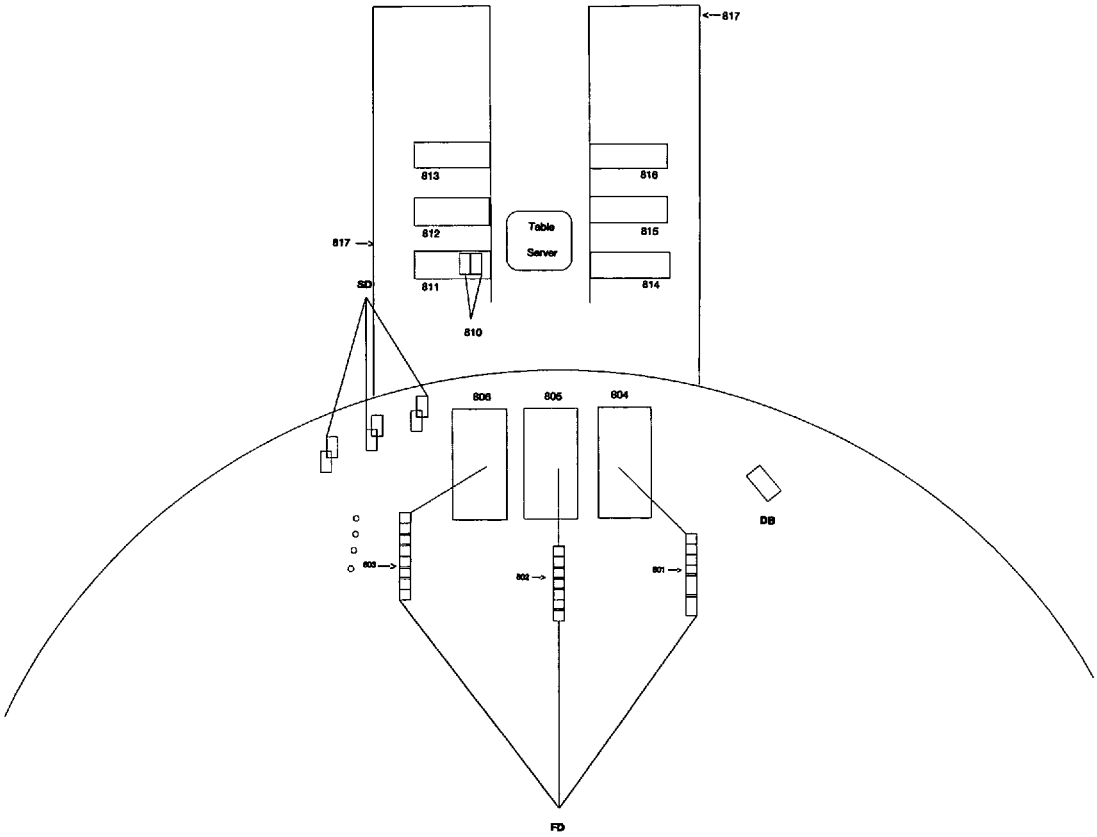
FIG. 8 illustrates an enlarged top view of the area around the Table Server, not drawn to scale, including the sideboards around and the cloth in front of the dealer, with pair cards midst the Table Server Stand By field on the sideboard and with three frames for different decks and stacks on the cloth in front of, according to an embodiment of the invention.

In addition and related on the card game table for six (6) players a minimum of six (6) decks including the sixty (60) cards for the final deck (55 regular cards+5 Jokers or Wildcards) may be needed for each value category. Thus as illustrated in FIG. 8 three (3) times the six (6) decks of sixty (60) cards 801-803, and so three (3) times the three hundred and sixty (360) cards, at all one thousand and eighty (1080) cards may be needed to be stacked in front of the Table Server. These cards also should be equally separated due to the three different types of cards, the stacks for three different value categories marked and prepared due frames 804, 805, 806 at least imprinted on the cloth in front of the Table Server (See FIG. 08). The cards to be dealt out of a final deck are prima vista drawn in a random way though the chances and probabilities to earn a Joker 701 or another needed image of a face card are countable, at least in case of a deal for a particular amount of cards in addition.

It has been found that due the method to warrant each player the same chances to earn a particular card the final decks 1211 (See FIG. 12) are needed to be piled up in a so called deck separated way which means that each shuffled final deck should be stacked behind another shuffled and complete final deck. In this manner the Table Server is obliged to offer each player the needed cards in addition out of an own complete though shuffled final deck, stacked behind and maybe separated so as to differentiate between the different complete decks (and maybe by using a small sheet of paper). Prima vista a random selection is shown to be dealt though with enough deals the needed face card(s) can be calculated on.

Thus for each stack of each value category as described it is needed to prepare an all time stand by stack, which stack includes the six (6) final decks piled up with each sixty (60) cards a deck stacked behind and beside the two other stacks for the other value categories. After a deal for cards in addition the broken shuffled deck is required to been taken out of the stack, to be refilled, to be shuffled and to be stacked to the other decks again (usually on the top or the other way round) while it builds a help for the Table Server to use small slices of paper to differentiate the so piled up stack for each needed deck. It may be efficient to stack at least six (6) final decks behind and for each value category at least to warrant the fluent deal for the cards in addition with all needed refilling processes in the meanwhile. At all three (3) all time stand by stacks—the three categories offinal decks 1212-1213 are placed on the cloth in front of the Table Server, at least in some embodiments.

The present method of offering a social card game that does not primarily depend on chance and randomness, and on the other hand includes a small aspect of luck while dealing the cards out of a shuffled deck, requires a realistic and accountable chance for each player to calculate on a particular card, if urgently needed. Bad luck should not prohibit a connection between amenable players who at least have enough money (to buy additional cards) and with enough cards in exchange.

Thus with a final deck of fifty five (55) regular cards and at all of sixty (60) cards, exactly five (5) Jokers or Wildcards are included in the deck, the probability and chance to earn a Wildcard or Joker out a complete final deck just prima vista drawn in a random way, is exactly 1:12 (5 to 60 cards) for the first draw and 1:11.8 (5 to 59 cards) for the second draw and 1:11.6 (5 to 58 cards) for the third draw and in that way 1:11.4 for the fourth draw and 1:11.2 for the fifth draw (here for five cards in hand), in particular and in general related on each draw for the first Joker or Wildcard.

Furthermore it has been found due practised experiences that in the case of a deal for all five cards in addition at once, for example, the exchange of several cards to complete a full hand or the buy of all cards at once, the chance to earn at least one Joker or Wildcard with that deal and draw is nearly 50 percent. Thus, in case of such a deal and at least in case the three times earn of a full hand with five cards during that deal it is nearly for certain to earn a Joker or a Wildcard out of an own separated and shuffled final deck, at least experienced and proved due a serial try to find out that with all multiple tries (a quarter of an hour) for a full exchange of five cards at once at least the second try consequented a Joker with at least one card of the five cards earn. In that way it was presumable that nearly for certain a Joker or a Wildcard would be dealt at least with the third draw out a shuffled deck of sixty (60) cards, shuffled in an averaged way.

Though it builds a method at least in some embodiments that just one chance, the so called second chance is offered to buy cards in addition, it is ruled that with that deal and chance as long as wanted and as many cards as wanted allowed to be bought, depending on the amount of allowed cards in hand and on the money of the player to repeat these deals and exchanges. In that way with the second chance deal several deals for all cards are offered and in principle as long as wanted. Thus if a player (usually an offeree) is seriously willed to win together with a special offeror and nevertheless the fitting pair card in hand is missed, that player is with a certain chance to earn that fitting pair card, at least due a Wildcard or due to a Joker 701. It has been respected that in the case of eleven (11) different face cards for the eleven image categories in a deck, and with an up to five (5) cards in hand play, the (5) times offered eleven (11) regular cards are included a sixty (60) cards final deck the Joker or Wildcard is no regular card, and in that way of course the chance to earn a needed graphic depiction and image category of a card used for a pair is the same as described above for the Joker or Wildcard. But related on the unique bluff method of the HAPPY JOURNEY TO LOVE game and so not to intend to win with the recent player it can build a need to earn the Joker or Wildcard, at least to answer it one other offeror of another turn. It has to be respected that the offeror in principle is not in knowledge about the earned cards in addition (the second chance deal for the offeree is requiring to be handled discretely) though in common the Joker or Wildcard can be guessed due a different design on the back 701 (see FIG. 7).

At least it is the answer of a pair card and so the prove of a pair in front of the Table Server and the expressed confirmed will to accept the partner and player behind, that is building the win. The winning consequence for the pair is at least the doubled amount of the values behind the pair cards usually paid in money and the proved will to spend a common time together. Therefore and in addition the Table Server is advised to hand over a special envelope including at least one of different vouchers, a voucher for a movie theatre, for a candle light dinner, for a concert, for a hotel suite or more, in principle depending on revenue agreements with related companies.

To reach the aim of the game and due the remain silent rule it is required to communicate at least due the way of played and offered face cards and in some embodiments at least due a card first to be contended in a face down way. Therefore it is not just the artfull design on the face of each card the reason to initiate a winning feeling between at least two players, also the indicia, marks, numbers, graphic depictions, colors, paintings, pictures and optical illusions on the back of each card are needed for the HAPPY JOURNEY TO LOVE© card game or STREET IN & POKER IT ALL© game. All of these indicia on the back of a Feel Well™ card are created to combine the face of that card due a chosen and offered indicia on the back, usually utilized through an offered face down card.

Figure 3:
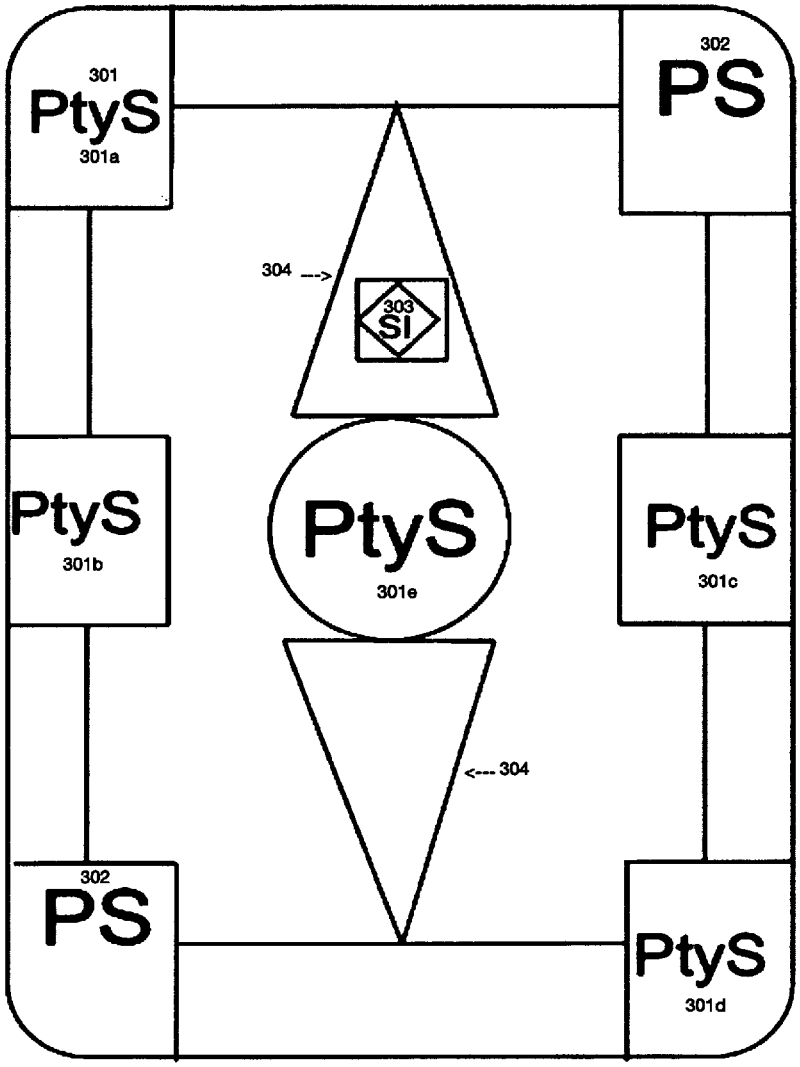
FIG. 3 illustrates the positions of some special marks printed on the back face and first described due functional abbreviations (SI, PS, PTyS), enlarged and not drawn to scale, according to game required meanings and functions as an aspect of the invention.

FIG. 3 illustrates an example of a back-face of a rectangular game card according to an embodiment, which includes three (3) different and functional designed categories of marks. One kind of indicia (which may be a Pair-Symbol—PS) is placed in the right top-angle and to the left bottom-angle, diagonally opposited, while the second kind of mark (the Personality Symbol—PtyS) is on different portions (for example, one to the left top-angle, one to the right border middle, one to the right bottom-angle, one to the left border middle and one in the middle or center) of the back face. A third kind of indicia, which may be called the Hot Sex Symbol (the Secret Indicia—SI) may also be placed on the back, but not on all cards. For example, it may be placed in FIG. 3 on the illustrated acute triangles on the back of each card, a frame of an acute triangle 304 with its acute tip printed up and down each card, the shortest side beginning at the circle for the symbol in the centred mid of the back and with its acute tip to the short line of the card's border frame midst.

In detail and example of the Pair Symbol and its at least two counterparts on the back face (see the parameter) 302 are illustrated in FIG. 3, one of at least two ruptured parts for the whole Pair Symbol, for example, a part of a Yin-Yang type of symbol, which may be needed to answer the offeree at least the required question, if an own chosen card in hand does probably fit to the face down card offered or if at least one other card is needed to be bought for a winning pair and so for fitting faces of the pair. All marks on the back of a card are at least designed to answer similar questions in a vague way. Furthermore that Pair Symbol and its parts, in detail the form of that indicia beside its color on the back may be implemented to show also an information about a probably foreseen good future for a probably fitting pair due a reasoned imagination about a fitting touch behind a good decision, the harmonizing parallel decision for the fitting parts of the Pair Symbol 302 in hands of both of the players, for example, the two parts of a ruptured heart, all of these fitting cards at least earned with the second chance. In that way the Pair Symbol on one back of a card of a first player shows at least one of two ruptured or one of two portions that can form a complete picture or symbol, with the meaning to combine the two parts when one of the portions is in hand of the offeror and the other portion is in the hand of the offeree (that is, a fusion or combination or cards to form a Yin-Yang symbol, for example). In the case wherein the counterpart of a split mark is printed on another card, probably the card is in the offeree's hand. It has been found as understandable that one portion of an indicia (for example, one broken part of a heart symbol) can reasonably be imagined as a desire for a complement and if in hand of the other player (offeree) it can be reasoned to prompt a positive response.

Thus a pool of different Pair Symbols, seen as categories, are characterizing the whole feeling behind these symbols (e.g. a heart symbol as a category or a Yin-Yang symbol or a two melted rings symbols as a category and so on) while these categories of different symbols in whole are related on the different faces and its image categories. The rupture or separation lines or cut of these symbols and its result of at least two parts can be expressed by a straight line or by any type of zig-zag or other shape separation (such as a puzzle piece) to provide a somewhat tricky or degree of difficulty in the effort needed by a player to determine if an image on one of his or her cards will fit or not the counterpart image, including considering the category of the symbol while in principle attached the particular category of the image and face at the same time (the cateogry of a heart or Yin-Yang). A particular face card within the same image category of each deck should present the same category of a Pair Symbol at all directed on different decks. In that way at least eleven (11) different Pair Symbols are required for the fifty five (55) cards start up deck; or for the sixty (60) cards final deck and depending on the amount for cards in hand more or less Pair Symbols are needed to be utilized.

The Table Server and after his lay down of the face down card of the offeror is advised to suggest the offeree to have a closer look at the symbols on the back of the contended card. In that way that part of a symbol is able to empower the offeree's imagination at least for the Table Server's foreseen fitting success for both players due symbiotic feelings behind the two players in principle fitting parts of the Pair Symbol (at least the category is fitting) in the hand of the offeror and of the offeree. Maybe therefore and due the indicia given hint for an in principle fit, the offeree is with a first good feeling directed on the until now hidden face of the offeror and in case of her symbol of the same category in hand. To earn a certain feeling for fitting faces due the fitting parts of Pair Symbols it may be that the next dimension may require an identical color of both parts of the symbol to reason a good feeling directed towards a win with fitting face cards and so with needed pair cards. Thus at least one part on the back of the offeror's game card may be needed to fit one counterpart on the offeree's card to reason a first positive response. The parameters influencing the fit can be seen in the whole form of the symbol and its separation line (which may be zig-zag or other shaped separation) or in the detail of the specific separation line and its outlined different cut while the different faces of the cards within their image category should present different images and categories of the Pair Symbol at all and with all decks. In addition it may be required to match or fit identical colors or to match different colors of the parts for the symbol and the needed amount of parts to complete a symbol are further influencing the fit. All in all it is the form and the color of all parts for the Pair Symbol, whether fitting or not, that is informing about a probably forseen good future with that offeror and about a certain fit of the winning pair faces, the face of the offeror until now is hidden and face down. It is the method to combine puzzled symbols with identical and sometimes different colors of at least both parts of the Pair Symbol that is requiring to inform more about the player due to his or her chosen symbol on the back of the offered card in combination with its hidden face. It is the character of the player, the unique face of the chosen and bought card and its hint of a Pair Symbol on the back that all is needed to influence the further path of the game, while at last the color of the parts for the Pair Symbol can tell about a fitting face and face card for certain, proved due the identical colors of the Pair Symbol on the back. That means that just the definitively fitting faces and face cards are with the identical colors of the Pair Symbol on the back at least in a player obvious way, while all of the other maybe fitting, maybe a bit fitting or just in general fitting parts and forms of the Pair Symbol just can tell about a probably forseen good future of a probably fitting face and player, due the uncertain method behind.

Following that method the offeror and the offeree is advised to take time and at least for a closer look at the offered card and at its back. Due the method behind the print of the symbols to print the parts on the back and on all cards of all decks in a parallel way (e.g. the first parts of the heart symbol on five cards within a deck are in principle fitting the counterparts of these cards of another deck) it depends on the detailed outline and its ruptured part how strong the expectation of the offeree for a fitting face card and its symbol on the back can be fulfilled even in case of parts with different colors. So seen a gradually hope or dissatisfaction due fitting or not fitting cards can be built and sole the identical color can satisfy that hope for certain while different chances to offer identical colors of particular Pair Symbols or to offer different outlined parts of one and the same Pair Symbol are required to be calculated on different cards of different decks.

In some embodiments, the forms and parts for the Pair Symbol are printed on all of cards, with the start up deck and with the final deck, but in other embodiments the parts of the Pair Symbol are on the cards of the start up deck and just on some cards of the final decks and the other way round, or on less than all of cards with all of different decks. The method to differentiate exactly fitting and non fitting cards of two players at first is requiring the draft for parallel decks (start up decks or final decks) with in generally parallel printed parts of the Pair Symbol on the back of all different face cards and at least in principle fitting due the same category of a symbol. In case of parallel cut outlines for the ruptured parts of a symbol out a category obviously all parts are exactly fitting all parts of another deck due equally ruptured outlines. Thus in that case different mistakes and deviations (e.g. through a mix up of faces and related on the categories for the symbol) are needed to empower the method behind the identical colors. Thus and not to mix up the categories of symbols too often in some embodiments the whole Pair Symbol is ruptured due to different parts and outlines (e.g. a heart ruptured due different forms of bolts). In that case always two decks within all decks are needed for the particular counterparts usually opposite formed printed on same positions, while all these decks are usually prepared in a pair amount. In that way sole two particular decks of at least six decks would present all of the same face cards with its corresponding counterparts of the Pair Symbol on the back (at the same time each category of a face would fit each category of a Pair Symbol). All of other decks and combinations for same faces would nevertheless present corresponding parts of at least the same category of a symbol (e.g. the two parts of a heart in general though not truly fitting exactly due different forms and outlines). The fitting or not fitting aspect in case of different ruptured symbols (with no parallel cuts) would depend on the chance to earn cards out the right decks and so out the counterdecks. Thus the players at first will guess about a probably fitting aspect behind the card and player in common (at least in case of the same category for a Pair Symbol on the back) while the Table Server is now advised to inform that just the identical color of the parts for the whole symbol can answer a fitting face for certain.

In some embodiments the amount of deviations and mistakes implemented the decks of in generally parallel printed parts in a parallel cut (all decks and symbols are fitting within the same category of faces and symbols) or implemented the decks of different ruptured Pair Symbols on the back (just two decks are with the right counterparts per category) are increasing or decreasing due different variances. For a parallel cut and its decks it is one deck and its five face cards showing the same faces within an image category (eleven times five face cards) that is requiring a mistake due a mix up of whole symbols e.g. on the fifth face card of a category and with each deck, thus its different symbols on the back are not fitting due different forms and categories at all. In that way different other combinations of deviations and mistakes are imaginable and able to mislead the players while always sole the fact of fitting colors of some parts of fitting symbols on the back has to inform about fitting faces for certain. While the objective facts behind the manner and deviations to print the parts for this symbols on different cards of different decks can forsee each fitting aspect behind that calculation, the personal impressions of the players won't find out the certain way except in case of identical colors and therefore the tension due the generally presented uncertainty even behind in principle fitting symbols can be hold.

Thus it is also a method to surprise the offeree at least after the face up of the offered card. While the offeree maybe will still doubt about a fitting face behind the offered card (face down) the face up can surprise due in general fitting faces with in principle offered parts of symbols of the same category at least seen in a statistical way.

It is contemplated that a particular character of a player may inspect the tiny different outlines at least on his own face cards (with the choices for the cards in hand out the particular start up deck) for each image category, (e.g. four of these cards are with a parallel cut part of the Pair Symbol and the fifth back is with a completely other formed part) and in that way she or he would calcuate on that way and print, possibly printed with all counterparts. Thus the mistakes and devaitions are not published and are printed in a tricky manner and due different ways intended not to be guessed and to be found out, so that the positive surprise of fitting face cards can help the offeror in a positive way. In some embodiments the Table Server is advised to inform about the importance of the Pair Symbols on the back in general and about the certainty in case of fitting colors in particular.

In some embodiments, the second indicia on the back face of a game card (the Personality Symbol—the PtyS as a parameter shown in FIG. 3 and as variances shown in FIG. 13) is comparable to a logo in the clothing industry. Thus, that type of indicia is required to provide information about the closer education of the particular offeror, while a seriously calculated description (due different parameters) for different educations is needed to create these different marks following needed categories for different meanings, for example, categories for women and men, and each for different ranks of educations. Therefore all offerors are advised to select the needed game card(s) not just due a closer look at the face or due a look at the back of a card, but to respect the perspective of the offeree which is a must for the win of that game, too. In some embodiments the chosen indicia is printed such that it is centered or on the middle part on the back (for example, the PtyS in the middle of the circle illustrated in FIG. 3) of that card to underline the central aspect of that function and meaning behind. It is the function of the Personality Symbol to decide for it just in combination with the chosen face of the card while the meaning to present exactly that combination of a face and of a corresponding Personality Symbol on the back of a card is the unique expression of the offeror to show an aspect of a possible deeper character behind, able to attract the interest and the like of the offeree. In that way it has been found as practicable to design that symbol while starting with two different aspects as the presumption to build the whole of the so called Personality Symbol, at first the aspect for men and then the aspect for women. In some embodiments these two parts (e.g. for men and women) are printed on the back of one card at the same time, seen as one symbol and to combine the same information behind in form of a split graphic depiction due differences in gender related perspectives. A symbol of an arrow e.g. should express a sharp and spicy character for a man while a sharp split of a diamond should express the same meaning for a woman. Following that method the detailed configurations of these symbols (each for men and women) are requiring a lot of graphic categories and depictions to influence the discipline to go on with the offered card due a closer information about the individually presented personality behind the contended card.

The Personality Symbol on the back face, for example on the left top angle (as illustrated the PtyS in FIG. 3) is printed also on different positions of the back of a card and may include special parameters to express different educations. In some embodiments, the method to influence the players includes an understanding of a logo in the clothing industry, presented to enable the offeree to guess a closer character behind the silent player due that expression. With that indicia it is intended to give a lot of information in a shortest manner due to the graphic design. The offeree, and to the time before her or his decision to go on with an offered face down card, at least is attracted to find a first common interest due to the expression of that individualizing indicia. Like with feelings to decide for a shirt of Ralph Lauren or for a shirt of Paul Shark the indicia should signal a common taste at least behind the feeling expected with the disclosure of the graphic depiction on the face, still hidden due a face down card in front of the offeree, while that moment of a face up is intended to build one of the convincing moments to win due a contended card.

In some embodiments, it is necessary to verbally describe the parameters for a particular mark to be able to express the well feeling behind this symbol at least related on different educations. Due to the need to combine that indicia and meaning with the meaning of the graphic depiction on the face of the chosen card that mark wants to inform about the HOW, how that offeror and the offeree would interprete the contended face on a particular face down card, in case of going on with that card and player. Due to this aspect the offeror is asked to combine all card related parameters of his or her strategy to convince his or her offeree and first meaningfully shown due the chosen "Personality Symbol" on the back of his or her card. Therefore different and gradually different designed Personality Symbols dedicated to the back of game cards are required to be available. At least each player should be able to decide for one of two different symbols related on one face card and printed on the back though to increase the individual aspect of the game as many as practicable prints of different symbols are needed to be offered. Nevertheless the fact that each player is unique it has been found that in the embodiment with a start up deck of fifty five (55) cards at all and with a five (5) cards in hand maximum rule of at least eleven (11) different faces offered, the option to decide for one (1) of five (5) different Personality Symbols can not be increased. To enable each player to take each possible combination of cards for his hand (e.g. 2 faces X, 1 face Y, 1 face Z, 1 face A, or, 5 faces X, or 1 face A, 1 face B, 1 face X, 1 face Y, 1 face Z and so on) and with all of these combinations to take one and the same Personality Symbol on each back just five (5) different Personality Symbols allowed to be printed on each card, at least with a five cards in hand rule. In that way 11 (the different faces) cubed 5 (the amount of different Personality Symbols on each card) and so one hundred sixty one thousand and fifty one (161.051) different combinations can be offered at least 161.051 offerees. At least it is the combination of the face of the card with the particular Personality Symbol on the back of a face down card that builds the needed convincing method to win the game in case of a face down card rule.

In some embodiments more than five cards in hand are allowed (e.g. in principle 150) and so more of eleven different faces to combine are allowed and more than fifty five cards are included all of regular cards for a start up deck. In that way the complete amount of Personality Symbols on the back of one or more different cards can be increased enormously related to the method utilized for the fifty five cards decks.

In some embodiments as illustrated in FIG. 3 it has been found as practicable to print the five (5) different Personality Symbols—PtyS 301*a*, 301*b*, 301*c*, 301*d*, 301*e*—on each card to the left top angle, to the right bottom angle, to the left border midst, to the right border midst and to the center of the card. The center of the card should be ruled as the eye catch of a main information in case of different symbols and information printed on other parts of the back. Therefore it is easier to offer the meant Pesonality Symbol on that position of the back of the offered card. Due to mathematical restrictions it is required that with each hand of five same cards, the same faces of the same image category, just one card of the five cards a category is with the same Personality Symbol on the centered middle of the back. Due to the need to offer different players different Personality Symbols on that main position it is the rotating way to print each of the five different Personality Symbols to the centered middle of the back of the particular cards (e.g. for the five same cards in hand) that can warrant at least one meant Personality Symbol on the centred mid position. In that way different players can combine one and the same face with different (here with five) Personality Symbols on the center position of the back of their cards. On the other hand in case of a use of five different faces on a particular hand, faces of five different chosen image categories, each card in hand can present one and the same particular Personality Symbol on the centred mid of the back. Due to this restriction and due to the fact that a player may not be able to offer each player his or her Personality Symbol (at least one of five) on the centered middle of each chosen card and back, the Table Server is asked to assist and to communicate the true meaning and so the player's particular Personality Symbol (e.g. the PtyS symbol 301*a*- to the left top-angle as shown in FIG. 3).

In some embodiments, in cases of no cards being available with the needed symbol on the centered middle position (e.g. that card is no longer in hand), or in the case that in general none of the Personality Symbols can find the opinion of the particular player, the offeror is asked to advise the Table Server that, for example the symbol to the left top-angle or to the right border middle is individually meant as the presented Personality Symbol for his or her offeree, or that none of the symbols can find and express the personality of that player in particular, nevertheless the example of the symbol on the main position. In that way an optimized amount of Personality Symbols can be chosen and utilized by each player at least restricted due the method of a five cards in hand rule.

In some embodiments the back of the HAPPY JOURNEY TO LOVE or STREET IN & POKER IT ALL game card is sole marked with Personality Symbols and the game is played with a more than five cards in hand rule. In that way a lot of Personality Symbols can be printed to each back face of the cards of a deck, depending on the seize of the card and depending upon the practicability to separate them, and possibly depending on the amount of cards in hand. In that way each player is with a lot of choices to offer a particular symbol with a lot of the same cards even though in that way not always on the main position, the centered middle. Thus the Table Server is nevertheless needed to assist with these symbols.

The form and creation of the Personality Symbol and its two main aspects, is at least expressed due two split counterparts (e.g. one for women and one for men) though in comparison to the Pair Symbol these parts are not seen as ruptured parts of one image. It has been found as a need to print at least both parts and both main aspects of the Personality Symbol within one position of the back in a mirrored style. The mirrored style is required to print the male symbol or the female symbol on the top of a position while the corresponding part is printed below like the image mirrored on a lake.

It is contemplated that the development of multiple functions including indicia that at least twenty two (22) different Personality Symbols for each player of a particular sex are practicable to be described and created throughout an unique graphic depiction for each symbol, sometimes an optical illusion, to build a first galary of likes for personalities, as first descriptions for different educations and behaviors. Also needed are parameters requiring to manifest six (6) categories of at least six (6) lived educations, needed as a first definition of different Personality Symbols. In detail at least three included (3) main educations are representing the three life-styles in common people's life and three (3) included styles of behaviors are completing these different main educations. In that way a questionnaire may be needed to obtain information and imagination of different randomly asked people to better describe the likes and definitions behind first drafts of indicia of the Personality Symbols.

The first category at least is including different parameters for a top (I) education, described through different life-styles: the honest style, the zero prejudice style, the interested attention style, the argument and contra-argument style, the fair way style, the disciplined loyalty style, the innovative curiosity style, the secret truth style. These verbally described life-styles are building first parameters for at least one of three categories of educations. The top education (as described above), the mid education (II) and the strange education (III). The mid education (II) is requiring at least the parameters of the style of a true but not really honest life, further the sympathy depending life-style, the self interested style, the reflex communication style, the fair and unfair style, the opportunity loyal style, the sole nova reperta style, at least the secret obscure style. The strange education (III) is requiring at least the parameters of the not truly honest life-style, the unfair sympathy style, the rude confrontation style, the deaf for other interests style, the always looking for others style, the copy innovation style, the see and immediately take it all greedy style. Related on these parameters of three (3) mainly described educations three (3) different styles of behaviors are required to complete a first definition to create a first version for each design and depiction of a Personality Symbol. The excentric and free style behavior (I), the bit blocked and intro style behavior (II), the permanent hidden and secret style behavior (III) are needed to complete the first drafts for Personality Symbols.

In some embodiments different details, not described to open up, are further requiring to present micro needed gradual differences to respect micro different aspects of people and tiny differences in graphic depictions behind all of the Personality Symbols, which may be prepared and designed although in generally the tiny differences should not inflict the pair character of in principle identical faces and symbols (for men and women). Thus just picky players will remark about or notice these differences (e.g. to talk about later and then maybe relaxed).

Figure 13:
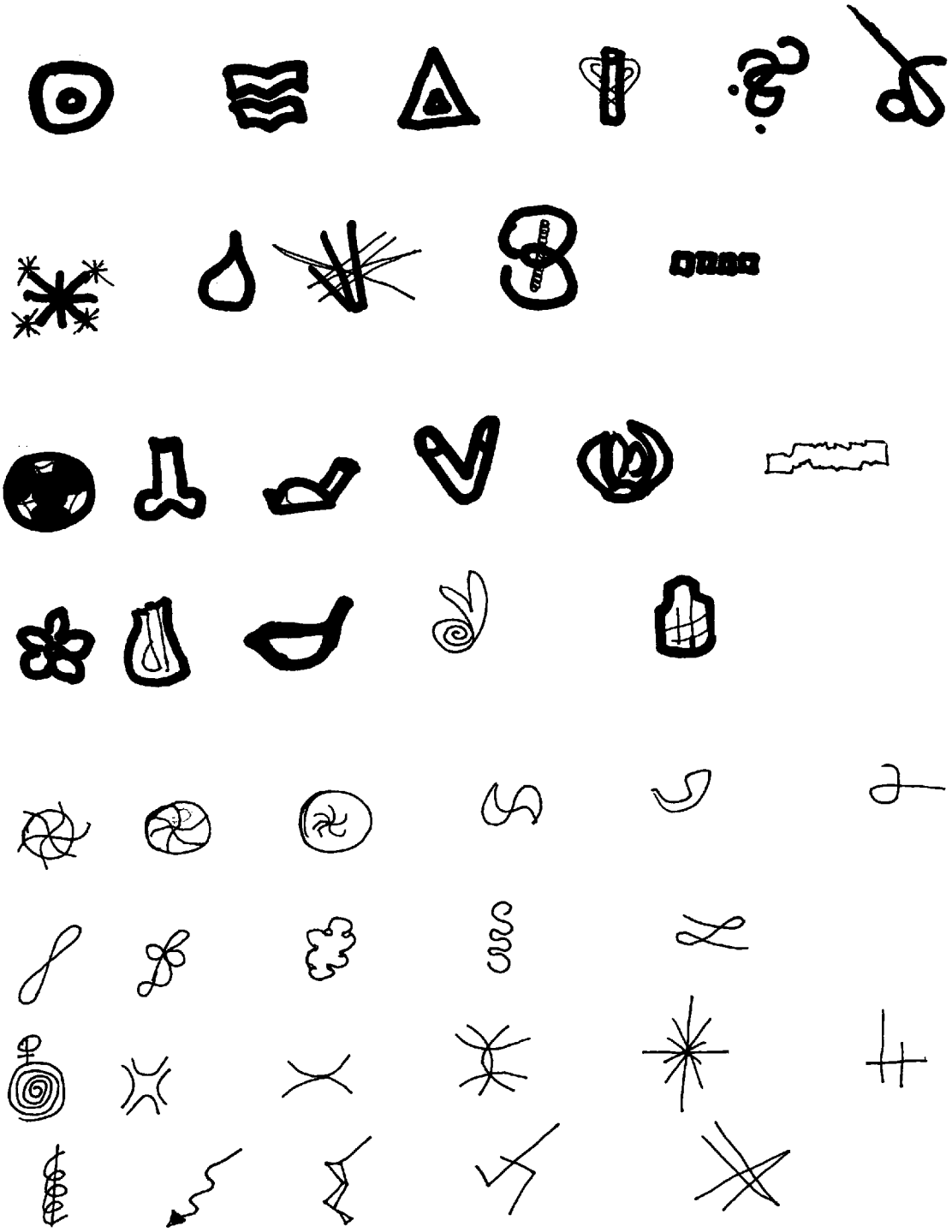
FIG. 13 illustrates the twenty two graphic depictions for the pool of Personality Symbols, not drawn to scale, to be printed on the back of the trading and sametime playing card, according to an aspect of the invention.

The particular twenty two main Personality Symbols as illustrated in FIG. 13, and designed for each gender, are gradually succeeding the above described method and path from a top education (I) to the category of a strange education (the crazy-lazy education) as a third (III) educational category, all indicia are including the aspects of the three different parameters for behaviors behind these styles of educations. In that way a pool of at least fourty four (44) Personality Symbols (22 for women and 22 for men) can be utilized and can be printed on at least fifty five (55) regular cards and on their backs, in some embodiments on the backs of the Jokers and Wildcards, too. Nevertheless in case of a five cards in hand rule just five symbols are required and needed to be printed on a card of a particular deck. Different other Personality Symbols can be developed in future and in principle at least depending on the main stream of educations related on the game invented method for educations and behaviors.

In some embodiments sole four own created symbols are printed on the back while the fifth Personality Symbol of a back and card builds a question mark and in that way has to replace another Personality Symbol, usually the last possible to be printed on one card, while the rotating method to print even that question mark to the main centred mid position is ruled in the same way. Thus the symbol of a question mark is required to offer each player the chance to hint for his individual Personality Symbol in form of the question mark (whether on the centred mid or wherever). In embodiments with more or less than five cards in hand rules more or less than four created symbols can be combined with the question mark on the back of one card. In some embodiments the different parts for the sex behind the Personality Symbol are not printed within one and the same position on one card at the same time and it is up to the offeror to decide for a female symbol to contend or for a male symbol to contend his/her individual Personality Symbol, even in case of a male offeror. Usually the so needed start up decks requiring to include the doubled amount of regular cards and so one hundred and ten (110) cards. In case of the doubled amount of a regular start up deck (of 110 cards) that amount has to be doubled, of course, to utilze the unique print method. In some embodiments all of other different combinations of embodiments and to combine different indicia with a particular Personality Symbol are given and presented.

In all embodiments it is the first introduction of the offeror while offering the individually chosen and face combined Personality Symbol as a first disclosure of his or her character (the HOW) behind his face. It is also the first introduction of the offeree to answer the (maybe) fitting symbol with her fitting face card. The offeree in case of an intended win has to prove and answer a fitting or matching face card and can ask the Table Server to lay down the card in a face-down manner first, at least to show the offeror her or his individually chosen symbol and character (which may include taking the option for a 10 minute time out, the Table Server's Stand By, for a first small talk between the players otherwise the offeree will answer a pair and fitting face card immediately).

The third kind of indicia of a HOT SEX SYMBOL, or the Secret Symbol—SI 303 in FIG. 3, and in detail is printed in a random way and only on the back of some of the cards of at least a start-up deck (therefore it is not allowed to waste these special symbols). In some embodiments it is a need to print or to paint this indicia midst the frame of at least one acute triangle 304, as illustrated in FIG. 3, while the other cards without that symbol are just with the plain frame for the acute triangle. The HOT SEX SYMBOL can predict a dreamful intimacy due to the fire behind the indicia. The Table Server is advised to explain the Egyptian history of that symbol, a symbol Cleopatra may have desired, and due to a magic vision while looking at this symbol and due to a magic glance in so delighted eyes of the player a perfect sense and intimacy can be forseen for a particular pair at least due one card of these special indicia and of its optical illusion character. The game cards thus may be designed to provoke or stimulate such feelings and to encourage game play for the offeree and offeror to build a winning combination.

Different chances to earn this symbol in different embodiments may arise depending on different decks and the images printed on different cards of particular decks, and such decks are required to offer this rare chance to fit such symbols in addition though the particular design and depiction for this symbol is not intended to be disclosed, except on the particular cards. The oracle meaning behind that symbol and intimacy at least may be explained by the Table Server. The method to utilize a playing and trading card with such symbols may increase the worthy moment of that playing card and at the same time of that trading card in case of a winning pair including one of these cards and in case of a decision to take the card instead of part of the money won. In case of a common acceptance of the game developed trading cards this method and symbol can increase the value and the desire for such a card enormously in comparison to all of the other winning game cards without this symbol on the back face.

Figure 5:
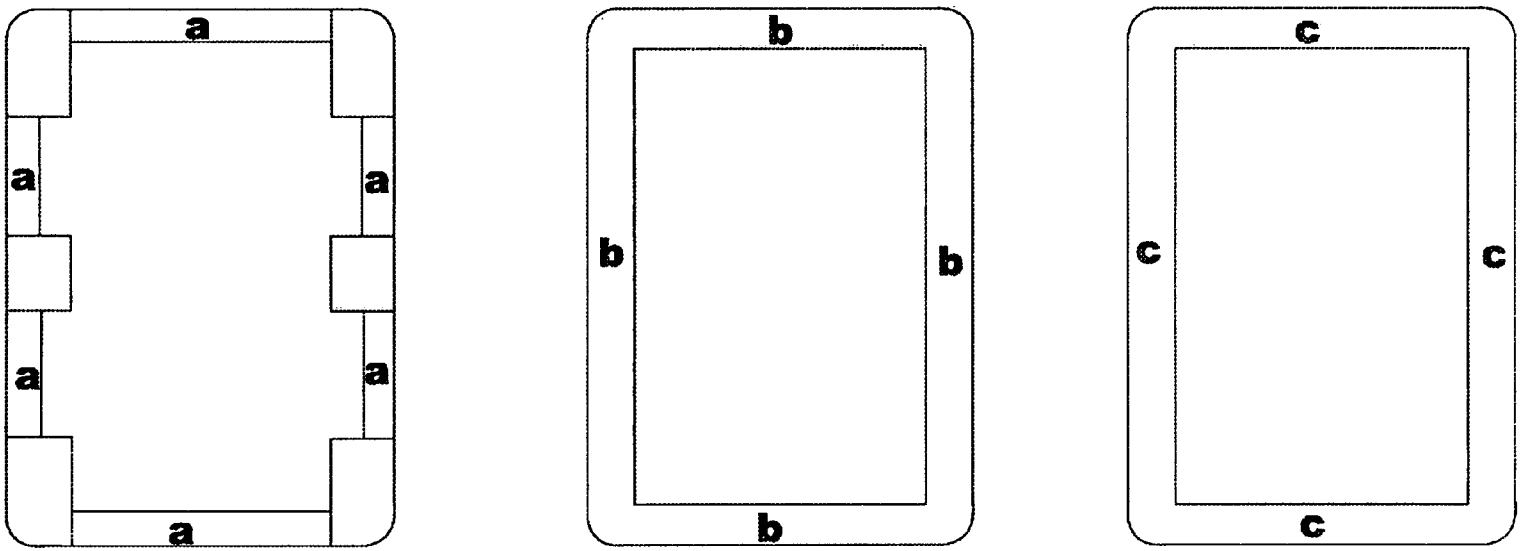
FIG. 5 illustrates different frames on the back face of some trading and sametime playing cards, not drawn to scale, seen as different colors according different values of the cards and to an embodiment of the invention.

In some embodiments, another indicia on the back of each card requires a special color of the back in general and in form of a colored border frame on the back—e.g. frame (a) in FIG. 5—needed to define at least one of two (2) or three (3) different values due to two (2) or three (3) different colors, (a), (b), (c) in FIG. 5, which may indicate different prices behind the chosen cards. In some embodiments at least three value categories are needed to increase spectator's and player's interests. The different colors on different border frames on the back of a card as illustrated in FIG. 5 (see also the frames for on the cloth in FIG. 8) are symbolizing the different values of cards. Thus each player is with his or her first decision calculates the right value and the right amount of cards to take to play a hand for at least one turn of the game. The in generally needed indicia of a colored frame is not just to present the prices for different cards with different tables (tables for youth and for older players), also the method can utilize a particular card to win (with) a special player due to a monetary aspect of that card, seen in a philosophical given understanding (for example, less is sometimes more) builds the true need for. On the other hand and in case of a traditional monetary understanding no player knows about the certain future to win with his or her first offered card but then the other bought cards are losing its value (though at last a voucher can calm the case of a first card win). The way to decide for the right amount behind the cards may depend on the right strategy of the player directed on his or her first decision due to a short look at all different players around the table (usually at the other sex) and after a silent calculation on imaginable characters behind other players. It is up to an individual player to make the decision to chose exactly the right amount of cards in the right category of the price for the exactly given turn, while just one price and value category is allowed to be taken for a hand. At last the fluctuating aspect and for other players has to be put in perspective. In some embodiments the Table Server is needed to ask for the right value and prices of cards at first and each player while each player is asked to calculate for the needed value and for the needed amount of cards in hand depending on all circumstances. In some embodiments at least a split of all different values behind all needed cards, directed on different players and on two different tables for players, is required to present comparable chances for each player. One table for very young players (18 to 25) is needed to offer cards of a lower price and at least one other table for older players (26 to infinity) is needed for a higher income. In detail at least one color for the back or its border frame, for example red may represent a price of two (2) US dollars or 2 Euros per card as a minimum while that card with a table for older players has a price of twenty (20) US dollars or 20 Euros as a minimum cost to purchase cards. In that way all different prices for cards of different tables have to be seen in that relation.

In some embodiments at least three different colors for three different prices of cards of a deck are required to be offered each player. A second color (b) in FIG. 5 such as silver is at least of a price of five (5) US dollars or 5 Euros for the youth or of fifty (50) US dollars or 50 Euros for older players, while a third color (c) in FIG. 5 such as gold is of a value of ten (10) US dollars or 10 Euros and on the other hand of one hundred (100) US dollars or 100 Euros. Following the different parameters for the game it is sometimes better to chose a higher value for cards in hand and sometimes a less is more in regard for the turn and table. Older people (26 to infinity) are in principle allowed to play at a table for the youth though not the other way round. In some embodiments different cards of different values are allowed to been taken for one and the same hand, otherwise just the case of losing all cards in hand can offer the chance to upgrade or to downgrade the former value for a new hand and in some embodiments all of imaginable combinations of values in hand are allowed. It is a main aspect of the playing method for the HAPPY JOURNEY TO LOVE or STREET IN & POKER IT ALL card game to reason good feelings due to a harmonizing fit or match of different decisions. For example, for same face cards of at least two players of the game, due different symbols and indicia on the back or due different values behind the cards and more may build another aspect of the game to initiate special feelings and interests in players due to her or his chosen face cards, and aspects also increase the motivation for a decision to buy another needed game card in addition to those already in the player's possession, and dealt by a Table Server in a random way, seen as a good luck aspect. It has been found that people in common want to feel influenced at least by some portion of luck to decide for a partner or for a love or for a nice entertainment together, and therefore this need is also offered and fulfilled by the present social card game, but the social card game should not be considered as a betting game or as a random game of pure chance.

The focus of the present social card game is nevertheless the unique face of an in principle self chosen playing card, to be offered the desired offeree. Thus the decision for the right faces in hand is a very important part of the game. All artfully designed cards for the game are the results of psychological proved images to bear dreams about a shared love, about sensitive couples, and about erotic feelings behind convincing acts and actions, or about other similar symbioses (e.g. in fashions, kiddy toys, hobbies). At least eleven (11) different image categories with related graphic depictions on the faces (exemplary illustrated in FIG. 4) are presenting different styles and pictures, graphs, marks and optical illusions dedicated to result lovely dreams of both players, the offeror and the offeree, while each category is thoughtfully required and created to reason good feelings for both players. At least there is no HAPPY JOURNEY TO LOVE possible without the special cards, on the other hand it is sometimes possible to play the game sole with a simple use of those cards in general. Each artfully designed card of each image category is required to represent win influencing parameters, such as erotic designs, or hobby designs, kid designs, and fashion designs, which may be calculated on at least eleven different likes or interests that people may have in common. These common interests may require a verbal description that may be provided by answers obtained from questionaires that were obtained from answers of randomly asked people. In that way different categories and parameters are used to create the special designs and graphic depictions on the game cards.

Figure 4:
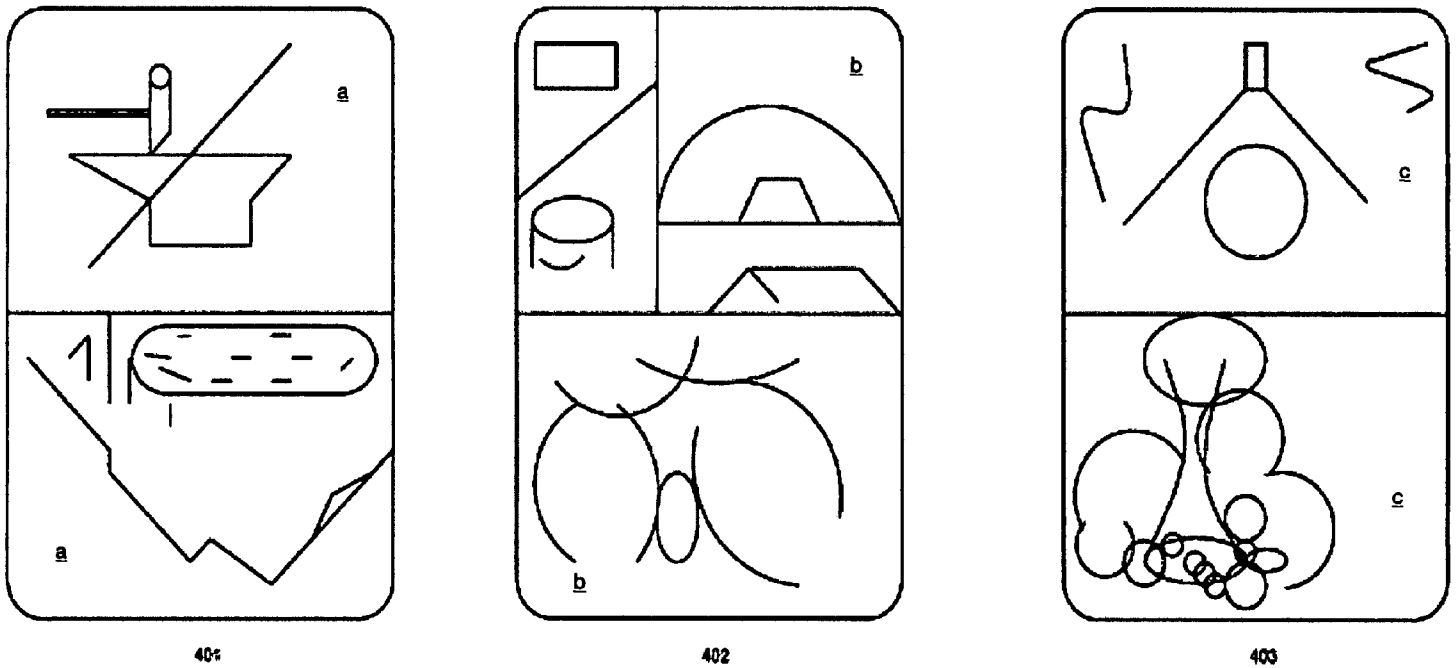
FIG. 4 illustrates examplary some of the artfully painted images on the front faces of the cards, trading and sametime playing cards, not drawn to scale, according to game required meanings and functions as an aspect of the invention.

In some embodiments the faces of all regular cards are split in the half of the card to print two different though mirrored paintings and in detail the split parts of paintings, combining the two different aspects of life due one and the same like, on it (see face (a) of card 401 in FIG. 4). It has been shown that players due to two main differences in interpretations (women—men, navvies—intellectuals, techno freaks—classic fans, soft touch characters—hard core fans and more of such different educations) often are imagening the same and the all meaning though in form of two substantial different images. Thus the mirrored complement on the face of one card is needed to help the offeror to conquer the unknown lover or to help the offeree to agree the offeror due an unique understanding in form of the corresponding graphic depictions on the card, e.g. 402 or 403 with face (b) and (c). The corresponding image is printed to the second half of the face on each card, in that way the eleven (11) image categories are split at least to twenty two (22) graphic depictions and pictures (examplary illustrated also on the cloth in FIG. 1) on all cards a deck, and on all decks for each value category. It has been experienced as a serious calculation to develop at least eleven (11) styles, e.g. for erotic designs, to start up a game while verbally described parameters led to artfully painted images on different faces. The corresponding painting for the second education (women-men, navvies-intellectuals and more) is following the same creation method.

As examplary shown and illustrated in FIG. 4, at least eleven (11) depictions as consequences of descriptions for eleven different erotic-styles and seen as one like of a lot of possible likes (fashion likes, hobby likes, toy likes, . . . ) are individually completed due eleven complements of descriptions and at last graphic depictions on the second half of the card, so twenty two different depicted images are painted to all cards. The HAPPY JOURNEY TO LOVE or STREET IN & POKER IT ALL card face descriptions are utilized for different styles of erotic interests, all are including at least eleven verbally expressed categories for the so seen dsiciplines. The first so described style is defined due a traditional method behind the erotic like and builds the first of eleven categories:

1. the parameters for this style are describing the discipline in a conservative undertsanding. The romantical, waving, dancing and good mood discipline while the corresponding style is including the parameters for the hard working, sweat inhaling, slow steel and the gentle manner discipline.
2. the second style is defined due another method and discipline including the parameters of the progressive, experimenting and the high tensed discipline while the corresponding parameters are the settled pioneer, the exploring new and the always prepared discipline at least.
3. the third style and discipline is including parameters of the early legal, the forbidden exception, the to know to know nothing discipline while the corresponding parameters are including the green touch, the stop it-high danger and the to know to know nothing discipline.
4. the fourth style and discipline is including parameters of the quick and full satisfaction, the oral action and the tolerant dicipline while the corresponding parameters are the fast head to toes, the different trembling and the secret cosmetic discipline.
5. the fifth style and discipline is including parameters of the mix it up, the whole spectrum and the staccatto discipline while the corresponding parameters are including the combined strategy, the use it all and the drumming discipline.
6, the sixth style and discipline is including parameters of the mix it up, the whole spectrum and the andante discipline while the corresponding parameters are including the combined strategy, the use it all and the waving silk discipline.
7. the seventh style and discipline is including parameters of the erogenos, the stroke the dots and the foreplay and no more discipline while the corresponding parameters are including the herogenos, the link the dots and the turn on and up for a next time discipline.
8. the eighth style and discipline is including parameters of the sportive, the stretch it all and the marathon discipline while the corresponding parameters are including the olympic, the bend and stretch and the biathlon discipline.
9. the nineth style and discipline is including parameters of the shy and help, the hesitated look and listen and the how-where-whenever discipline while the corresponding parameters are including the young and solidarity, the ask and wait for surprise and the how-where-whenever discipline.

10. the tenth style and discipline is including parameters of the much too less, the multiply it all and the three, four up to often times discipline, while the corresponding parameters are including the much too good, the come on and the stay with me and the often times discipline at least.

In some embodiments the eleventh style and the description of its parameters are building the last image category (for a 55 cards deck and a five cards in hand rule) and therefore that graphic depiction (the two mirrored paintings) on the face of at least five particular cards are not allowed to be published, and so not on the cloth of the card game table.

11. this eleventh style and discipline is including parameters of the centrifugal, the ice dancing and the clear water discipline while the corresponding parameters are including at least the storming, the cyclone and the shaggy player discipline.

Following at least all defined descriptions for the disciplines behind the eleven card image categories that may be required to artfully paint these meanings and disciplines (here for erotic styles) the fused and complete image is painted at least through two (2) corresponding paintings, graphic designs, optical illusions or other graphic depictions on different faces and mirorred on each face like an image on a lake.

With a start up deck of fifty five (55) cards at least five (5) cards are needed for the eleven (11) different image categories. To decide for five (5) cards and images of the same graphic depiction for all cards in hand or to decide for different combinations up to all of different graphic depictions at least builds the strategical decision of each player. The method to design the HAPPY JOURNEY TO LOVE cards may require creating new detailed parameters for leading descriptions over time. Specially developed questionnaires may be used for different people that may lead to different parameters and thus different types of images and/or image categories to be created and painted, and in such manner all of the other likes or interests behind the faces can be created. In some embodiments all or other combinations utilizing different main categories for different interests behind different disciplines (e.g. fashion and car race images combined with movies and music images combined with all of imaginable likes) may be printed on the faces of the game cards to fuse or unite at least two special players for at least one special interest, like and/or entertainment. Beside these impacts, methods and apparatus, it is the special tactic required to reach the aim of the game though in addition each individually utilzed improvisation within the rules of the game and judged by the Table Server that can increase the result enormously, on how best to win the game.

The chronology of the special tactics and rules behind begins with the decision of each player to take his or her seat around a game table and to have the right look to be able to decide for the right cards for his or her hand, to win with at least with one other player sitting around the game table. The social card game is played silently (with non-verbal communication between players) with a number for each player and seat (as illustrated in FIG. 1, the numbers 1 to 6 are used for the six player card game table, with a seat for a Jumper that has no number but may have the indication "Jumper" 200 on the cloth (see FIG. 2) on it).

Figure 9:
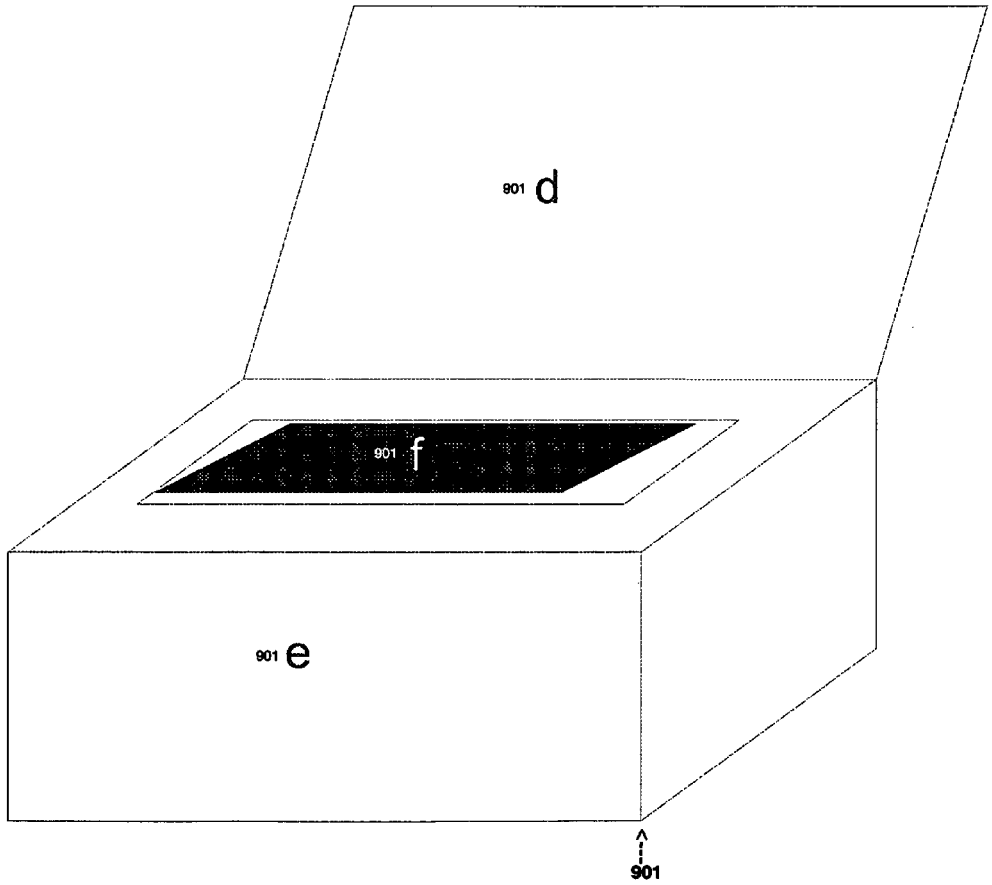
FIG. 9 illustrates a cube shaped box for the start up decks usually including fifty five cards, not drawn to scale and with a lid on the top, according to an aspect of the invention.

In some embodiments, the Table Server or dealer introduces himself or herself (the dealer may be an employee of a casino, for example) and then begins with a short explanation concerning the main and recent rules of the social card game, including any extraordinary given options for the game. Thus, in the case of a complete Table (having all six seats taken by six players) the dealer or Table Server begins the game of a particular day and as used to do so with each turn asks all players to observe the other players and then to decide a correct value category, so that each player pays the correct prices for chosen cards in his or her hand (usually two and up to five cards in hand). FIG. 9 illustrates a special decent box with the box 901 (*e*) and a lid 901 (*d*) and within the start up deck of fifty five (55) cards 901 (*f*), in detail a deck with five times eleven (11) different face cards, seen as playing and sametime trading cards. In some embodiments, a special HAPPY JOURNEY TO LOVE or STREET IN & POKER IT ALL game related rule states that in principle the cards for the game are to be bought and to be played, and no card is primary allowed to be taken away, so that all cards have to stay with the table and thus with the Table Server or dealer. Jumpers, however, have a regular right to take up to five cards a hand with them to play at different tables, although just after their first obligation to take a regular seat and to buy at least two and up to five cards as a regular player but then to leave the table immediately thereafter. After that deal, a player may become a Jumper by leaving the table he or she is currently at before the next turn begins. In such a case, the Table Server or dealer may allow a player who declares himself or herself a Jumper to leave the table with all of his or her cards in hand. That player then becomes a Jumper and is permitted to play with his or her cards without exception when occupying a Jumper swivel chair at another game table but just allowed to play one offer and so one turn at a particular table. In that way Jumpers have to utilize different tables in a so rotating way. In case of no more cards in hand Jumpers have the right to repeat the deal for the cards with a regular seat as often as wanted and in the same way (the way to fill up a Jumper's hand).

In some embodiments a second exception of the rule for all players to return all dealt cards the Table Server is to take at least one winning pair card with him or her as a part of the winning amount (and sometimes instead of the particular winning money amount). Winners who decide to do this have the right to play again with that card or to give it to a beneficiary as a present, or to keep it for a collection, or to use it as a trading card.

In that understanding each regular player around the table is with his/her first decision to decide for the right value and for the particular prices of cards and in that way for the particular start up deck in its decent box 901(*d*),(*e*),(*f*), (see FIG. 9) to be dealt by the Table Server with the statement to put back the not needed cards and to put in the required amounts of money (prices for the cards within the particular value category) and at last to return the box thereafter.

In some embodiments, the next step for each player is to decide for the right amount of cards in hand, usually dealt two (2) up to five (5) cards, the unique face cards with the Table Server's explained symbols on the back and to be utilized in combination with the thoughtfully to be chosen faces while to respect all parameters around the table at the same time. Thus, beside the choice of a right value category for the right valued faces and cards in hand each player of the HAPPY JOURNEY TO LOVE or STREET IN & POKER IT ALL is especially required to calculate on the right amount of cards in hand, too. Due to the rule and method that just the doubled amount of the risked and of the won pair card builds the main win, in a monetary understanding and behind the particular playing card, it is risky to take a lot of cards because in an early win situation remaining cards in hand are handled as losing or another pair of players could win the game with the first offered card. In such a case, a rule may be enforced that game cards that have not been used must be surrendered back to the Table Server or dealer and thus lost by that particular player (and as a win for the Table Server and/or casino). Such a rule is comparable to the loss of cards of dissenting players and players who did not win, and thus all of the lost cards must be returned. On the other hand and in case of utilizing the bluff method of the game with the first card, and neverthless to lose some other cards in hand immediately (maybe also due to one offeree with an expected positive meaning behind the PASS field and to offer again) it is better to play with more cards in hand (which depends on the particular strategy being used by particular players around the table). It has been found that in some cases players, after the loss of all cards in hand, will sometimes change tables in an effort to improve their luck. The decision for the right amount of cards in hand is therefore tricky.

Thus the present social card game requires a player to select his or her own strategy and options (which may include the price of game cards) regarding the right hand and the amount of cards to be bought, at least in a calculated and estimated manner. However, an option that may be available to each player, which may be called the oracle voice, may be offered to each new player (for example, a player who has no cards in hand) regarding a special method to calculate the right amount. The oracle voice method provides, by the Table Server or dealer, individual answers to the particular new player based on at least eight (8) game related questions. The oracle voice method uses an unique poll that must be answered in front of all of the other players at the table. In this manner the right amount of cards in hand can be calculated by the new player as suggested by the Table Server (as an option to take this oracle voice as a good advice), and the special developed questionnaire can serve to build the chance for each player to verbally introduce his or her character and personality a bit due to the answers given to the game-related questions. The answers to the questions are not supposed to compromise the strategy of any player and therefore just general answers like—that fits at all,—that fits particularly and that doesn't fit are used as responses. Nevertheless this oracle voice method is just an option and each player can decide whether to not to use it, and thus can stay secret and play without using this option and to calculate for himself or herself the correct amount of cards to have in hand.

The method for the oracle voice behind the calculation on the right amount of cards in hand for a particular player may consist of at least the following eight questions as part of the questionnaire or poll (mainly related on the importance with regard to an offeree), and the following abbreviations mean the following: AF=All Fits; PF=Partially Fits; NF=Nothing Fits (which may be interpreted as gradually seen with regard to importance to the offeror).

1. Money? AF—PF—NF
2. Single? AF—PF—NF
3. Hush/Hush—Enticement—SilentSecret? AF—PF—NF
4. Health—Care—Creativity? AF—PF—NF
5. Direct—Fair—Humor? AF—PF—NF
6. Sportive—Disciplined—Crazy? AF—PF—NF
7. Lazy—Just Interested—Sozializing? AF—PF—NF
8. Virgin—Curios—Unreachable? AF—PF—NF It is the unique combination of utilizing also one comprehension for different questions and each question utilizing three possible answers or notions, although all of these questions to be answered by using one of the described general answer statements. Due to these questions all of the other players and/or spectators around the card game table are able to obtain some information about that particular player who provided answers, and can utilized that information along with information later related to the published images and game cards played by that player on the game table, and players using their different imaginations may be able to deduce or figure out at least some of the motivations of that player.

On the other hand the mathematical formula behind the valuation process to calculate the correct amount of cards for each player in some embodiments should stay secret, and also related parameters behind the answers and their importance to result a needed amount of cards should stay secret. At least the promise to utilize an optimised amount of cards in hand to a particular player and in that way to win and not to waste cards as a first strategy and method directed on the whole concept behind the game can be given.

In some embodiments, the following special formula may be used by the Table Server to value each answer from the player in a particular manner, using the following valuations:

1. Answer—AF=05 PF=10 NF=20
2. Answer—AF=05 PF=10 NF=20
3. Answer—AF=05 PF=10 NF=20
4. Answer—AF=05 PF=10 NF=20
5. Answer—AF=05 PF=05 NF=10
6. Answer—AF=05 PF=10 NF=20
7. Answer—AF=00 PF=00 NF=05
8. Answer—AF=05 PF=10 NF=20

Thus, depending on the all added amount behind all questions and answers of the particular player, the Table Server or dealer can calculate and suggest an optimised amount of game cards for that particular hand, according to the following considerations. In the case of 27 points and more, then 1 card is suggested; in case of 54 and more impacts at all—2 cards are suggested; in case of 80 and more impacts at all—3 cards are suggested; in case of 90 and more impacts at all—4 cards are suggested; in case of equal 115 and more impacts at all—5 cards are suggested. In some embodiments it is a rule that Jumpers do not have the right to take the option of an oracle voice.

If decided due the oracle voice or due to an individually calculated amount for the correct amount of cards, the player (s) have to take time and now to chose their calculated win convincing faces and symbols on the back of the face cards, and at least to decide for the combination of same or of different face cards in hand. At last all decent boxes with the remaining start up deck have to be returned again, and each player is with his or her game cards (usually hidden from the other players) in hand waits for the Table Server (dealing with the money and with the regiven decks in the meantime) for the start up of the game (for example, the dealer will ring a small bell to indicate the start of card game play).

In some embodiments, the start up bell is rung and the Table Server may state: MAKE HONOR or of a FAIT D'AMOUR or of a ALLES LIEBE, and at least one player although usually more players, raise their hands to be chosen by the dealer, and have one or more cards in hand for the elected offeree or offerees to be presented with. In case of at least two players and offerors with their immediate hands up, it is the Table Server who decides on the priority based on an honest ruled way to decide for the first seen card and hand as a first priority. This rule and way is obliged with the begin of each regular turn while regulary one card of one offeror is offered to one particular player and with each turn, sometimes during the same turn.

In some embodiments more than one card of more than one offeror is allowed to be offered to more than one offeree at the same time, while in principle the methods to play the turn and game are handled in a parallel way and just each offeror has to decide which of his or her eventually different cards has to been forwared to the first, or eventually the second or to more of the particular players (usually named the Table Server) due to the notion of the first number for the first offeree and so on for the others to forward the particular card to the offerees and exactly in that priority the prior decision for the winning pair in case of same time claims for the win is ruled while in principle (exceptions can follow in the future) all of the other cards and offerees are losing with that particular win behind the particular prior pair cards.

The next effort for the Table Server is to listen to the correct order to forward the card(s) to the desired offeree (named due to her or his number on the game table or cloth in front of each offeree), and the Table Server then places the card face-down or in some embodiments turns a down card to face-up on the small white circle 117-122(*j*) (as illustrated in FIG. 1) on the cloth in front of the players. The correct order for should be TENDER IN FACE DOWN TO PLAYER NR. 1 or TENDER IN FACE UP TO PLAYER NR. 2. In the case of a face-down card, and in some embodiments the offeree is asked to take time with the offered card and to have a closer look at the symbols, it is generally explained by the Table Server (Pair Symbol, Personality Symbol, ev. HOT SEX SYMBOL, or the different meanings for the colored border frame and the value behind), and at least the offeree is asked to decide for a field on the cloth in front of and to order to forward the face down card on a particular field. As illustrated in FIG. 1 the three frames, indicated with 123-128, are marked with the W—WELCOME field, the SB—STAND BY field and the P—PASS field, usually the decision for a particular field is depending on the own strategy of the offeree. The face down card has to be forwared to the decided field (and depending on the particular embodiment) whether in a face-up way or in a face-down way; though in case of a forward to the PASS field, and due the game related ethic behind the turn the face up of that early losing card is not allowed due the rule not to compromise the offeror in that way. Thus as illlustrated in FIG. 11 at least a face-up card is just usually on the WELCOME field 1101 though maybe not from the begin while the lead of a face down offered card to the STAND BY field 1102 usually is requiring still a face down card on that field. At last the order to forward the card to one of the three fields is requiring the exclamation of a TENDER TO THE W or WELCOME, or of a TENDER TO THE SB or STAND BY or of a TENDER TO THE P or PASS field. In some embodiments it is ruled that just a face up of a card can be played and forwarded at least to one of the three fields in front of the particular offeree and then a face up card can be utilized on all of the at least three fields while in some embodiments all of possible utilizing combinations of these forwards are ruled.

The TENDER TO P or PASS order is requiring the rule that in that case the particular player is losing and in that way the offered card has to go over the counter and to the Table Server due a first dissenting opinion proved behind. Thereafter the offeror is with the right to offer another card to that particular offeree for a second time and in a second jingled turn (somtimes this offer is expected by the offeree). In principle the offeree has the option to use this order, the TENDER TO PASS order, until the moment the Table Server is asking for the last confirmation, usually proved due an exclaimed common will to take the pair as a win, the last act before a definitively given win situation. Thus this order (TENDER TO PASS) can be utilized after the pre-decision for the SB—STAND BY field, too and/or after the pre-decision for the W—WELCOME field at last. Also in case of an utilized bluff method (of the offeree and/or of the offeror) the TENDER TO PASS can be ordered and then maybe after the taken option for the ten minute time out by the offeree, the called Table Server Stand By option, to leave the table for a small talk (with the need and consequence to leave the cards on the cloth and to leave the potentially winning pair cards 810 on the particular frames 811-816 with the sidebaords 817 (e.g. the pair cards on frame 811) of the Table Server as shown in FIG. 8. Even in this case of a last doubt to take the win for certain the offeree (and just the offeree has to do so) is with the choice also to decide for a last possible break up due a not confirmed common will to take the win, usually explicitly ordered with a last possible TENDER TO PASS exclamation, otherwise the offeree will confirm the common will to take the win and pair and then the particular turn is over.

In some embodiments as shown in FIG. 11, another rule for the playing method is to decide for the TENDER TO WELCOME field 1101 order immediately (after the offer in front of the three frames 1101-1103), this method is requiring the rule that in this case the offeree is still with different choices to go on with that card and player (to forward to STAND BY 1101(*b*) to 1102 after a while, or to PASS 1101 (*a*) to 1103 after a while, to face up after a while or to go on in a longest face down way, and so). In comparison to the order for the STAND BY field 1102, the offeree has to play with the card on the WELCOME field 1101 in a prior manner.

The prior manner behind the W—WELCOME field 1101 is the obligation for the offeree to find a first end decision for that card (at least whether to win on the WELCOME field, the winning field, or to forward the card to another field, until now at least three fields at all). In comparison on the STAND BY field 1102 the offerors have to wait and to tempt patience while all of the probably offered other cards (usually of other offerors) are maybe handled in a prior manner or are also waiting on the STAND BY field after a while. Just one card at the same time is allowed to be played and e.g. to be forwared to the W—WELCOME field 1101 while it is allowed to exchange the cards and so to forward one card on a WELCOME field to the STAND BY field and the other way round, 1101 (*b*) to 1102 or 1102 (*b*) to 1101. Thus the offeror in the WELCOME case is at least just with a first realistic hope to win due his card on an early WELCOME winning field and maybe sole in a philosophical way. The straight way for the offeree (the quick decision for a win) to win with a card on the W—WELCOME field and seen as a first lead of that card to the WELCOME 1101 with the intention to win immediately is requiring the face up of the particular card 1104 at last; and at least in case of a face down rule as a first offer rule. Until the face up it usually depends on the back and on the symbols behind the particular face card and on the question or on the guess if a chosen fitting face card is hold in hand of the offeree or if eventually another card has to be bought with the second chance deal. In case of a face up of a card 1104 on the WELCOME field 1101 (or in case of a forward of a face up card to the W field 1102 (*b*) to 1101 the offeree is usually with the chance, the second chance to buy cards in addition, e.g. in case of no fitting pair card in hand. On the other hand the offeree is with the obligation to lose a card due the face up order in case of no fitting and winning pair cards. In some embodiments, the special face up moment will happen just on the WELCOME field and then just with the decision of the offeree to seriously win with that card, mostly due to the rule to lose one of his or her own card(s) in hand with the order of a TENDER TO FACE UP, except the definitive win with that card is following. In the case of a fitting face card in hand e.g. 1108 in FIG. 11 (probably shown before due to the identical colors of the symbol on the back) and still with the face down card of the offeror on the WELCOME field, the offeree (still in a quick decision mood) has the option to ask for the face up of the offeror's card. The request for a TENDER TO FACE UP will consequently get the Table Server to act to turn the card face-up 1104 and then after awhile the Table Server's obliged to ask for a SHOW DOWN, the request for the offeree, if a fitting face card in hand can prove her right to ask for a face-up, or if another card has to be bought with the second chance deal. The offeree at this moment has different options. The option to lay down a fitting card 1108 (usually allowed by herself or by himself) beside the offered card to prove the fact of given fitting cards and so of pair cards and then to wait for the Table Server's information about the chance to take a small talk and a Table Server's Stand By (usually the small talk happens at the bar of the gaming company or casino) or to wait for the Table Servers's request for a CONFIRM THE LOVE, the last needed verbally expressed confirmation of both players though just allowed to be communicated by the offeree. The further option to dissent the face and face card and its player due to providing a different card 1107 or just verbally stated in that way) and so to implicitly order the TENDER TO PASS but with the consequence that now the offered card and one of the cards in the offeree's hand (due the face up claim) are losing and are going back to the dealer. Another option is to buy more card(s) according to the second chance deal and to go on as described above. The further option is to surprise the offeror with an own answer due to providing a completely different and not matching or not fitting card (to face up) 1107 (*f*) to 1101 beside the card (face up) of the offeror with the request for the offeror of a special TAKE THE CHANCE and with the meaning of a change in turns, wherein now the offeree is contending her or his card with the consequence of changed positions, though restricted due the forward to the WELCOME field and so to take the chance or to leave the chance due the forward to PASS (the forward to the STAND BY in this situation is not allowed). The chance for the former offeror to go on with his or her desired player according to the game rules (usually before that option the former offeree is not with the personal option to buy other cards and not in possession of the fitting card), while the losing card of the former offeror is going back to the Table Server or dealer (he or she loses the card). In each case now the former offeror is obliged to answer and maybe in a negative intended order (why ever), usually exclaimed with a NO MORE CHANCES, and so the forward of the new offered card to the PASS field. In a positive understanding of a forward of the new offered card to the W field the former offeree is with a kind of priority to start a turn due this exception and the new offeree is with the chance to go on with his or her desired player in a restricted way on the WELCOME field nevertheless in a regular way though another exception and change of sides within that turn and game is not allowed. In some embodiments the former offeror is not restricted in any way (the forward to the STAND BY field is allowed) though it is not allowed for the former offeror to provide a new TAKE THE CHANCE strategy in a repetition way.

Beside the options of the offeree described above (in the chronology after the TENDER TO FACE UP claim), the offeree has another option but just a time before the TENDER TO FACE UP claim and as illustrated in FIG. 10 the offered card 1004 of the offeror is still in a face down position on the WELCOME field 1001. In this case the offeree has the option to surprise the offeror with an own answered card, by providing a secret face-down card 1005 (*e*) (which may be a match or not) and maybe this option is used to enjoy the answer and the surprisingly communication because of the two backs of both game cards. Due to the method behind the symbols on the back of a face down card the offeree usually does not know about a matching or fitting card in hand for certain (except in the case of identical colors of the fitting Pair Symbols) and in the same way the offeror does not know about the consequences. Just in that special option the offeree now has the choice to order a common face up with an exclamation for a TENDER AND ANSWER TO FACE UP and then it depends on the surprise of fitting cards or of not fitting cards, and so to win or to lose (again a kind of lucky moment is influencing). In case of fitting cards the win can be taken or not. In case of no match or not fitting cards then both cards are losing.

It has been found that in case of the intention to win with the recent offeror and in case of not fitting cards after the disclosure of an in common face up order (usually the order TENDER AND ANSWER CARD TO FACE UP) of the offeror's and of the offeree's layed down card the players are at least required to learn about the risk behind this strategy due the uncertain moment sole to be able to guess the symbols on the back of a card and its face in common (just the identical color of the Pair Symbol can prove two fitting faces for certain). Though it builds an exciting moment to answer the face down card of the offeror through a face down card of the offeree and maybe still in a guessing way and through the strategy to be able to flirt at least still due the symbols on the back of both cards, the obligated consequence behind the disclosure of not fitting faces is at least that all of the not fitting cards are losing and are going over the counter. As an exception of the rule in general in that case no chance to buy other cards with the second chance deal is given. Nevertheless the flirting aspect behind that strategy and the risk to play with an unknown face combined with an vague interpretation for the symbols on the back of the cards can reason the motivation to play that strategy and to take that risk at least for the price to wait for a second offer and turn of the same offeror (usually depending on other offerors and offerees).

But the offeree is with a further choice for a new turn and (see FIG. 10) to order an own offer due her/his face down card 1005 (*f*) but then with a prioritiy for a completely given new turn due the exlamation for a TENDER IN A FACE DOWN (and here just in a face down way) TO PLAYER NR (player nr 3 is the number of the former offeror, now the new offeree) while in that case the offeror has to go on with the new offer (face down card) as an offeree and in a new turn, the card of the offeror is losing over the counter while the new card of the offeree is in a new turn in front of the three fields (W—SB—P) of the new offeree and to be played as ruled in the game. In some embodiments it is a rule that after the ordered face up of the single face down card of the offeror (usually the order TENDER TO FACE UP or GEBERKARTE ZU AUFGESCHLOSSENHEIT) the Table Server has to claim a so called SHOW DOWN and so the offeree must provide a game card (probably a pair card) face-up. The fact that providing a game card face-up is a very disclosing moment requires the Table Server to, immediately after the order of a TENDER TO FACE UP on the particular WELCOME field, claim the SHOW DOWN to be fulfilled by the offeree. Thus, in case of a loss (e.g. no matching or fitting card in hand or the player is not willing to win) the offeror can't truly feel disadvantaged because both of the cards are in a face-up position at last due to the rule that at least the losing card of the offeree has to be shown. Though usually in case of the offeree's order of a TENDER TO FACE UP the card in hand of the offeree will fit, or the offeree is still with the chance to buy other cards (the second chance). If the pair card can be shown, the pair has to be confirmed by the offeree, at last due to an expression or exclamation of a TAKE THE LOVE. Otherwise the Table Server will claim the CONFIRM THE LOVE while informing about the Table Server Stand By option. If the offeree will not confirm the win expresses verbis at last it builds the loss situation for the players and the win situation for the Table Server. If the offeree does not want to risk losing one of her or his cards in the WELCOME situation 1001 (see FIG. 10) then she or he must answer the order TENDER TO PASS 1004 (*a*) before and without the order for the TENDER TO FACE UP. In some embodiments the SHOW DOWN and so the face-up of the offeror's and of the offeree's card on the game table is required and allowed on the WELCOME field, while on the STAND BY field just face down cards are required to be played. In some embodiments just face-up cards are required to be offered, answered and to be played in common.

In some embodiments, the SHOW DOWN and so the face up of the offeror's and more of the offeree's card on the WELCOME field can also be utilized for the unique HAPPY JOURNEY TO LOVE or STREET IN & POKER IT ALL bluff method and so not to intend to win, and more to inform another player around the table about the particular face behind the particular offeree. The Table Server is not engaged to prohibit that strategy at least due to the consequence that in case of dissenting opinions and the consequenting order of a TENDER TO PASS the playing cards are going to be forfeited or lost to the dealer or Table Server and a too early decision for a love was prohibited and no player was obviously disadvantaged. In such a bluffing case the offeree can also utilize the laying down (see FIG. 10) of her or his answering card in a face-down manner 1005 (*f*) to flirt with the offeror, due to the symbols on the back of the offeror's and of the offeree's card, and then to order a TENDER TO PASS 1004 (*a*) at last and before an in common face up of the cards while the own face down card is losing, too. The regular win situation are fitting cards beside on the WELCOME field, even after the in common face up of two face-down cards (the offeror's next the offeree's card), and in each case of a shown intention to win together the Table Server is nevertheless obliged to inform about the option to take a Table Server Stand By and about its strict rule to hold a ten minute time out. The Table Server before a last needed confirmation of the win is not interested in an early win of the players, at least due to the risk behind that definitive will and its exclamation but maybe truly due to the definitive loss of the pair for the Table Server. The ten minute time out and the Table Server Stand By is nevertheless required to be seen as a chance not to feel disappointed at last e.g. due to a too early decision for the win and thus the option is offered with a better to take a first small talk far the table and usually at the bar BUT then with the risk that, if at least a split of a second too late would happen (just exactly ten minutes for the small talk and for the come back and for the confirmation of a prima vista win are prepared) the waiting pair cards 810 on the sideboard and within the frames 811-816 for the Table Server Stand By (as illustrated in FIG. 8) are lost going over the counter. The too late arriving and claiming players are nevertheless with the right to go on with the game in case of other cards in hand and in that situation on the cloth (usually the other cards are layed down in front of the seat). Thus the Table Server is obliged to reserve the remaining cards and the seats around the table after the time out deadline passes (bit with a small tolerance for overtime, which may be at least a few minutes such as three minutes) otherwise a whole loss of all particular cards is ruled. The Table Server is required to utilize a timer for the Stand By situations while at the same time the players with their small talk are obliged to obey the restricted time exactly.

In case of an in time come back whether the pair is expressis verbis confirming the win (the offeree is obliged to do so for the pair) and is claiming to take the money or the money and the pair cards instead its particular amount and the voucher for promised amenities given in form of a closed envelope. In the other way the pair and its players are dissenting the common pair, the pair cards are losing and the players are with the right to go on with their remaining cards. This way builds the win of the Table Server due to dissenting opinions of the players. The card game requires and to all the time of a turn and game the special non-verbal communication of the players and sometimes of the spectators. In that way usually and due to the sensitive matter behind the game a straight and quick win and way to lead and play to on the W—WELCOME field is not to expect in a realistic way. Thus the tactic for the forward of the offered card to the SB or STAND BY field, if immediately after the first lay down of the card of the offeror or if due different forward exchanges of at least two cards, e.g. one on the WELCOME field and one still on the STAND BY field (as shown in FIG. 11) builds the main method to convince another player and at last to win with the desired love and pair behind. The order of the offeree TENDER TO STAND BY or SB is requiring a forward of the particular card to the field with the primary meaning that this card and offeror is at least in a waiting position while the offeree is at least communicating to play with other offerors in the meantime. The offeror is at least blocked for a round (but not necessary for a turn of the offeree with another player) and possibly in hope that the offeree will go on with his card (still in pole position on the SB field) at least after a round with another player. The round is defined due one decision to go on and due one act of a go on with a particular card (e.g one move with another offeror). The block due a card on the SB—STAND BY field means for the round that the offeror is not with the right to offer another card and not with the right to take on an offer of another card. After the blocked round and in case that the offeree is still not going on with the first STAND BY card the general block due a card on that field happens, what means that the particular offeror is with the right to claim the offeree for allowence to actively go on with another turn or to claim for decision about his/her card in the STAND BY (seen as an urge to do so and as an obliged priority if done so).

Thus in principle the offeree with the STAND BY decision is with a lot of time to go on however due the common risk of offerors to urge an offeree. The still playing offeree is in principle all the time of the particular turn (a turn at least between two particular players) with the right to go on with the first STAND BY card (at least one of more) and also with a negative TENDER ON SB TO PASS order. In case of a win with another player the particular offeree is leaving the table and then the card in the STAND BY is losing over the counter, too. Thus it is ruled that the offeror and his or her card on the STAND BY is maximum blocked to go on with his play (as an offeror and as an offeree) for one (1) round of the particular offeree, thus for one move of another offered card of a particular other offeror in a chronological understanding. In the case that the offeree is not able to go on with another offeror and immediately after the forward of the former card to the STAND BY it is usually another player starting a turn after the next jingle of the Table Server, and also that round counts for the definition of a blocked round (so seen the waiting time during a common round of other players). Thereafter the offeror is with the right though not with the obligation to go on with the game at least in an offeree's (taking an offer) way. The go on of the game in that situation means the option for the STAND BY offeror to take an offer as an offeree or to claim the decision of the STAND BY offeree with the consequence to make the decision and to go on with the STAND BY card in a prior way. Due the circumstance that offerors in a STAND BY of a special player are not willing to anger their desired offeree it is a risky claim to urge the offeree to make her/his decision in that regard. Thus it can be calculated on that with a too early claim the STAND BY offeree is angered and will order the TENDER TO PASS and maybe the chance to win with her/him is over forever now. On the other hand the offeree knows that the STAND BY offeror is just blocked for a round at least in an understanding to take an offer of another player and if another offeror would contend her/his STAND BY oferror the chance to go on with that STAND BY player is possibly over and forever, too. Thus also the offeree is advised not to take a too long time to wait with that offeror.

Nevertheless the STAND BY offeree is with a prior right to go on with her or his calculated tactic at least for the next move but in principle for the whole turn, usually it depends on at least the offer of another offeror to go on and not to go on with the STAND BY card. Thus in case that neither the recent offeree nor the STAND BY offeror can or wants to go on after the forward of the card to the STAND BY field the Table Server is asked to jingle for the next turn until at least the STAND BY offeror is claiming the declarative decision of the offeree to go on with his/her card, though it is not allowed to interrupt a recent turn. If the STAND BY offeror's claim for the decision due a MAKE DECISION PLEASE is made e.g. after a recent turn and in a last second to the jingle of the next turn and at the same the jingle is animating another player with the consequence of a prior right to contend his/her layed down card the offeree of the STAND BY offeror, a seemingly interference is happening due the nearly same time claim for the particular offeree, maybe reasoned due a clamor around the table. Thus the Table Server is obliged to judge, like King Salomon, at least in case of a quarrel for the priority. Due the meanwhile forwarded card of the interfering offeror in front of the three frames of the offeree and sametime due the unnecessarily overruled claim of the STAND BY offeror (the claim for the same offeree to make a decision about his/her card in a prior way was in time at least a split a second before the jingle of the Table Server) the STAND BY offeror is with the right for another claim, the so called STAY FAIR claim with the consequence that the particular offeree is obliged whether to forward the other offeror's card to the PASS field or to the STAND BY field in case of an unblocked field and then with the consequence of a lay down behind the recent STAND BY field and so with the priority of the first offeror in the STAND BY field.

In some embodiments, the STAND BY play and mode of the offeror is allowed instead of claiming the decision of the recent offeree, to claim for the allowance of the offeree to also go on in an active way, and so to offer other cards to other players and nevertheless still wait for an answer with the STAND BY card. Usually that claim is just declarative and politely given while the right to go on with particular offers and for both of the players (recent offeree and recent offeror) is given all the time and for the offeror at least after the block of a round. In general the STAND BY giving offeree has the right to go on and to delay the decision for the first STAND BY offeror until the moment of the particular offeror's claim for the decision or until the win with another offeror while the right to go on with the STAND BY card, also to the PASS field, is always given. In each case of a STAND BY play it is not allowed to collect cards of offerors in an up to infinity understanding. In some embodiments maximum two cards are allowed to be set behind and to been collected in this priority while in some embodiments more than two cards though less than ten cards are allowed to been collected and to be set behind. On the other hand also the offeror is with a tricky method and so to claim for allowance to go on with an active offering way after his block and then due a declarative YES allowed to offer another card the same offeree again. In that case it is allowed that the offeree is deciding for the STAND BY field again and then the field is blocked (in case of the maximum two cards the field rule) until the decision of the offeree to go on at least with one of the STAND BY cards of the same offeror, though also imaginable due an order for a forward to the PASS field.

In case of the interfering quarrel and the Salomonian Rule (and in case of a bright and quick STAND BY offeror he/she can provoke that quarrel with the other offeror in a very fast though hidden way and seemingly in a random way) the blocked STAND BY fields would build a strategically advantage because now the offeree is not allowed to use the WELCOME field and the new offeror in the salomonian rule has to lose in that situation due an obligated TENDER TO PASS order (the STAND BY field is no option here and due the two cards of the former offeror on the field). Usually it is a stretched hand of the offeror that claims the decision by the offeree at least a second to the jingle (so the offeror will maybe know about the silent flirt between the new offeror and the STAND BY offeree and will wait for the jingle in a very concentrated way before) and the verbal claim is in principle a secondary matter though necessary in that case.

Figure 6:
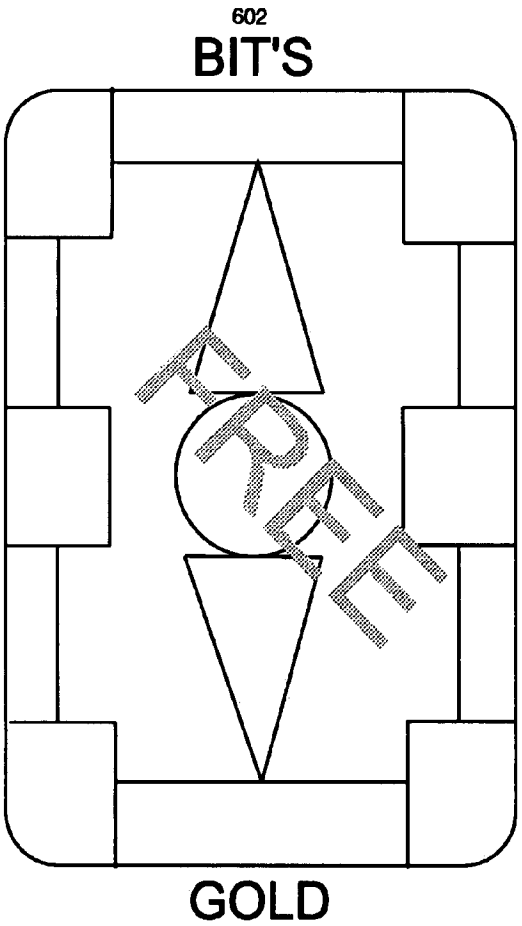
FIG. 6 illustrates at least two special free cards (ANGEL'S GOLD or BIT'S GOLD) for the game as an enlarged top view of the back of that particular trading and sametime playing card, according to an aspect of the invention.
Figure 6:
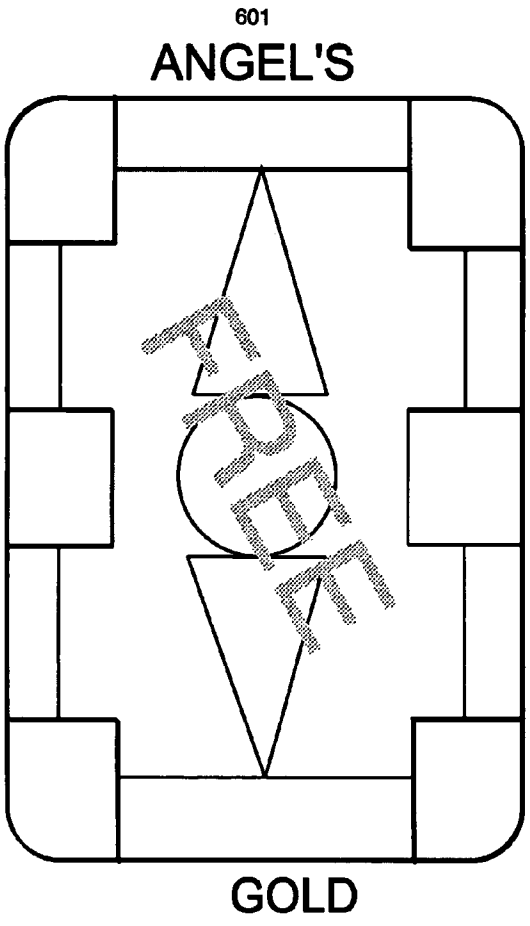

In some embodiments, when two cards of the same offeror are on the SB field and due to the option for the offeree to also forward both STAND BY cards of the same offeror to the PASS field and in principle at the same time it is required to offer the same chance and option for the offeror in the STAND BY and in that way to win with both cards (same or different face cards) at the same time on the WELCOME field (in case of a forward to). In the method of a two STAND BY CARDS ON THE WELCOME field the offeree is in principle with all of the given rules and methods to go on with the cards after the forward due to an TWO STAND BY CARDS TO WELCOME order, instead of the regulary utilized order of a STAND BY CARD 1 or 2 TO WELCOME. Due to the exception behind this decision a special and extraordinary winning amount is offered in case of two winning pairs with the same player and last confirmed by the offeree. The winning pair is whether taking the doubled amount of all of four pair cards' values in money with the common voucher in addition or the pair is with the chance to take the doubled amount of the first pair cards' value in money and in addition the exchange of the second pair cards into special cards of gratifications (as shown in FIG. 6 in general also used as free cards though with another value behind) the ANGEL'S GOLD card 601 for the female card and the BIT'S GOLD card 602 for the male card but then due a special expiration stamp on the face (also the name for the ANGEL'S GOLD© or for the BIT'S GOLD© in printed on the face and usually with the expiration stamp) the called INFINITY STAMP, given in the value of a true golden card of the highest value (each e.g. 100 USD/EUR), whether to play with again (also to be utilized in a colluded bluff turn of known players to exchange cards to money or beneficiaries with these cards in hand would use that bluff) or to collect or to sell as trading cards or to give them to other beneficiaries to collect or to sell. The exchange of the second pair cards is the win instead of the particular winning amount behind the particular two cards of possible different values due self chosen cards out of two different decks.

In some embodiments all of the combinations to utilize the WELCOME, the STAND BY and the PASS field with all possible exchanges of different offerors for one offeree are required while even an exchange in positions and sides in case of an offensive answer through an own offer of the offeree is ruled. In some embodiments all of the described combinations are requiring to be utilized with a ten (10) or twelve (12) players table with the related decks and combinations of decks and utilizing the method to allow as many offerors as wanted to utilize as many cards in hands for all imaginable offerees to contend due at least one offered card with same time offerors and offerees interdependend playing together though in principle sole two players can win at the same time the whole turn and sametime the game of the day though fluctuating exchanges and breaks for Jumpers are respected in the regular way. At last it builds a method of the game to warrant the needed fluctuation of players around the table. In some embodiments at least six (6) players around a table are needed to start up a game in general while at the same time it is allowed to to go on with the game in case of at least four (4) players though not less than four players. It has been found as a need to play at least with four (4) players due to motivating circumstances and therefore it is ruled that at least an interruption to go on with the game is obliged in case of less than four (4) players around the table. In that case the remaining players around are with the right to take their cards in hand and to go on as Jumpers, utilizing other tables, if wanted.

In the meantime of the break and following the method of a needed fluctuation the gaming company is required to give away so called gratifications and free cards, as illustrated in FIG. 6. The golden cards with the ANGEL'S GOLD©™ (for women) and the BIT'S GOLD©™ card (for men) are needed to complete and to fill the seats around a table within a given time and at the same time to tempt and to attract different spectators to play with a golden playing card, usually representing the highest value of a comparable playing card with a golden frame on the back (e.g. the 10 or 100 USD/EUR card). Therefore it has been found as necessary to imprint the character of a free card (the letters FREE) on the back of these cards in such a slight way that other players or spectators are just with the chance to find out about the true meaning and value behind due a closest look at the back in front of. The true value of these cards is the minimum value of the playing cards (e.g. 2 or 20 USD/EUR), at least in case of a winning pair with one of these cards. Furthermore it is required to limit the time to play with these cards due a stamp of an expiration time on the face of these cards (also the names ANGEL'S GOLD© or BIT'S GOLD© are printed on the face) a time of maximum a quarter of an hour to play with, otherwise that card is just proving a good nostalgic item or similar, though it can be used as a trading card, too. The different marks and indicia on the back of the ANGEL'S GOLD© or of the BIT'S GOLD© card are randomly printed on and are representing the way of different regular playing and trading cards. The different values of all cards in common are not influencing the right to answer a pair card of another value category as a winning pair though the winning amount is always needed to be calculated on the particular true value behind each card. In some embodiments it is ruled that gratification players with a free golden card are allowed to buy other ANGEL'S GOLD© or the BIT'S GOLD© cards in addition and in that way not just to start with an one card in hand strategy, more to start with a seemingly regular hand of up two five cards. In that way the ANGEL'S GOLD© or the BIT'S GOLD© cards in addition are with a price of the minimum amount (2 or 20 USD/EUR). This method builds another game implemented bluffing method to earn the seemingly true golden cards and so the highest value cards at a good price and to play in the highest value manner though that bluff is risky due the possibility at least for the particular offeree to find out about the true meaning and bluff due a closer look at the back of that card and at least with the face up of that card.

In some embodiments each game table surface or game cloth that is in front of each player may be adapted to include a touch screen (e.g. an iPad), which may have an internet connection so that players can access websites of special interests, such as hobbies, fashions, cars, sports, and news, to attract spectators and players during breaks or to look up common interests.

The game methods and/or rules described herein have been indicated with reference to the HAPPY JOURNEY TO LOVE or STREET IN & POKER IT ALL games, and the rules are meant to govern the flow of the game. However, certain rules can be invoked in an abitrary manner, or in some cases can be ignored, such as when players or the Table Server of the HAPPY JOURNEY TO LOVE game agree not to enforce one or more of the certain rules.

Although the present invention has been described in connection with specific exemplary embodiments herein, it should be understood that various changes, substitutions, and alterations apparent to those skilled in the art can be made to the disclosed embodiments without departing from the spirit and scope of the invention. Accordingly the present invention is intended to embrace all such alternatives, modifications and variances that fall within the scope of the appended claims.

What is claimed is:

1. A social cards game system for playing a social card game between a plurality of players, utilizing frames and indicia imprinted a play surface to legally place a card; the social cards game system directed by a dealer, comprising:

providing an "indicia-graphic-communication system", including different graphics and indicia imprinted at least a play surface, further imprinted a front surface and a back surface of legal playing cards and same time of legal trading cards, between at least two players around a game card table requiring to play a social card game in a non verbal manner around a table in a determined configuration and thus to utilize a process for a communication at least between two players of a different gender while each player utilizing self chosen playing cards for a determined hand with artfully painted graphics on the two faces of each card; a process requiring a harmonizing understanding to win a game together and at least due identical pair cards and thus due identical front faces shown down on a legal surface; a communication system requiring a step by step earned consent of at least two players directed at least on a special like and theme illustrated due a shown face of a legal playing card while the graphics and indicia on both surfaces of a playing card are correlated with and same time directed on imprinted graphics and indicia on a legal play surface, further possibly influenced by a shown playing card still in hand of at least a third player or possibly influenced by a face of a particular player in common, nevertheless concentrated on a particular face of an offered playing card requiring first to be placed on a mark in front a second player and then to be forwarded by a second player at least to one of the indicia imprinted a legal play surface in front of;

providing a configuration of conventional seats around a game card table indicating where players of a different sex and a dealer are positioned, wherein the arrangement having at least eight (8) seats with ordinals on and in a configuration detailed determining where a group of players of a different gender is positioned, the players sitting next beside on at least three (3) seats and opposite the seats for an equal amount of different players of the other sex, and usually "eye in eye" the other group; same time providing at least one of two exposed conventional swivel seats determining where a solitair player (a jumper) is positioned, a seat requiring a player of any gender to play at most one turn and thus at most one own placed playing card at a table; and configured at the opposite one exposed swivel seat for a dealer;

providing a game card table in at least one seize of a conventional oval table with a play surface in a conventional lining fabric on and requiring a determined configuration indicating at least the following indicia imprinted:

a print of a white circle-indicia with an ordinal number beside (a same number as a particular seat with a particular ordinal for a player is corresponding) midst above at least three imprinted frames for playing cards in front of each player, the circle-indicia indicating a neutral position of a first offered playing card requiring to be placed on usually in a face down manner;

further imprinted and below the circle-indicia a marking in form of at least three lined frames in the seize of conventional playing cards and all frames arranged parallel next beside requiring to indicate where a first offered playing card of an offering player (an offeror), a card first positioned on a neutral circle-indicia or later in a playing process a card also midst one of the three frames is to be placed next, further indicating where an answered card in hand of an answering player (an offeree) is to be placed next; —while a left frame of the at least three frames indicated by a conventional capital letter W, a first directed meaning of a WELCOME indicated frame, is further providing a determined path for options within a playing process to be taken and to be turned at least by an offeree and as an answering act in case of a fitting card in hand or at least in case of a fitting taste in common directed on all shown indicia at least imprinted one of two faces of an offered card of an offeror and/or of an answered card of an offeree or on the two players in a particular whole players situation in common; the act in an initiated consequence to legally forward and to place at least a particularly offered card midst a left frame (W) usually in a face down manner, thus to initiate a going on process on that particular field and frame utilizing a rule for an offeree at least to take a closer look at all graphics, signs or indicia imprinted a face of an offered card in comparison to the faces of playing cards at least in hand of the offeree, within an immanent result that the deeper the look at all graphics on a face and in a comparison the more information and the better the understanding for a required communication provided; further with another going on process on that particular frame to decide and to open up a face down card, thus to initiate a winning process usually just on that frame legal, the winning process at least in a consequence for an offeree to lay down an identical front face and so a fitting pair card beside an offered card or to decide and not to open up a face down card and to forward a game card on a (W) frame to one of another legal frame and/or indicia beside, or to lay down a playing card out an offeree's hand face down beside a face down offered card and to open up at least both of front faces simultaneously to find out, if identical faces and thus a pair is showed or not and to forward not identical face cards on a (W) frame to another frame usually indicated by a conventional capital letter P; or to decide and not to open up a face down card of an offeror on a (W) frame and to answer a new offered card out the hand of an offeree due a forward of that new offered card to a neutral circle-indicia in front the until now offeror while his/her until now offered playing card can be forwarded at least to one of the other frames; or to decide to face up a face down offered card and to lay down a not fitting card out the hand of an offeree in a consequence that now the offered card is losing and forwarded to a position midst a right frame, usually indicated by a conventional capital letter P, and now a new and by an offeree offered card is answering the former offeror to go on on that frame; —while a mid frame of the at least three frames indicated by the two conventional capital letters SB, a first directed meaning of a STAND BY indicated frame, is further providing a determined path for options requiring a playing process to be taken and to be turned at least by an offeree to primary answer a STAND BY wait in case of a fitting card in hand or in case of no fitting card(s) in hand or in case of a fitting taste in common or in case of no fitting taste in common; the process in an initiated consequence to legally forward and to place a particulars offered card midst that frame (SB), thus to go on with a particular card on a STAND BY frame just later in a playing process and after a determined time at least due a meanwhile taken comparison to playing cards of another player offered or not, and in a further consequence to forward the card(s) of the offeror(s) on a STAND BY frame at least to one of the other frames beside; —while a right frame of the at least three frames in front a player indicated by a conventional capital letter P, a first directed meaning of a PASS indicated frame, is further providing a determined path for options requiring a playing process to be taken and to be turned at least by an offeree due a forward of an offered card of an offeror midst that P indicated frame and in a consequence to legally exclude this offered card and thus an offeror from at least the particular turn and in a last consequence of a loss of a particular card and its related value as a win for a dealer;

providing and imprinted the mid along a play surface a stripe including different images, the graphics, markings and indicia providing a schematic illustration of overseized front faces of playing cards in a method to introduce nearly all of the different and individually designed front faces of playing cards next beside, except the image of one special playing card never to be published due; requiring at least a provided process to compare different indicia on a back surface of a recently offered playing card to all front surfaces of demonstrated cards along the stripe on the surface to imagine for the hidden front face of that offered card still face down;

further providing an apparatus for a dealer, a conventional rectangular box, requiring a seize exactly to put in at least three different sealed decks of playing cards, decks of same cards but indicated due different color frames on each back surface for at least three values of cards and decks, each deck including exactly at least fifty five (55) cards out of conventional paper or plastic or similar to fill up the box for a dealer, having a six walls rectangular construction with a lid wall on the top fixed along the longside of a bordering wall due a traditional hinge of a box, requiring to start a dealing process for each player due, directed to put out at least one sealed deck of a self chosen value category for self chosen cards and thereafter to put in the rest of a broken deck with the other deck(s) of the other value categories and requiring to put in an indicated amount of conventional money such as EUR/USD for each card out a value category, or to put in related traditional plastic tokens as an indicated money;

further providing an arrangement of two conventional rectangular sideboards in a fitting height of a game card table, each with a conventional lining fabric play surface to the left and to the right of a dealer with imprinted frames to place down at least one but in principle up to all possible pair(s) of winning playing cards of at least two players and for a determined time for the players to leave the table to utilize a verbal communication before a definitive win and consent is exclaimed;

providing at least two kinds of decks that each contain a plurality of at least fifty five (55) social game playing cards, each legal playing card having indicia on a front surface of a card and on a back surface of a card, wherein each deck of playing cards is assigned a monetary value due a related color for a frame on a back surface of a particular card, one of at least three value categories; while one of the two kinds decks requiring to be dealt not shuffled and usually sealed, including exactly fifty five (55) cards at least while each particular deck including different front surfaces showing at least eleven different themes due eleven different painted and printed graphics and indicia to express at least eleven different likes of players requiring a further method to combine corresponding graphics and indicia with both surfaces of a playing card for a fifty five (55) cards arrangement directed on a five cards in hand rule; while a second kind deck having exactly at least sixty (60) social game playing cards minimum, including the fifty five (55) legal playing cards plus five (5) determined extra-cards (Wildcards or Jokercards) in addition while the back faces of all extra-cards requiring to include all different indicia imprinted the back surfaces of all different legal playing cards and while the front faces of all extra-cards at least requiring a plain-white face divided by a fine horizontal line in the mid of a card; all second kind decks for all of the at least three value indicated categories requiring to be shuffled and so to build up three piles of monetary related decks in front of a dealer differentiated due different colors of the frames on the back surface of each card, such as gold, silver and red indicating related monetary prices such as 10 or 100, 5 or 50, or such as 2 or 20 EUR or USD; further requiring a dealer to sell these second kind deck's cards as cards in addition to a first bought hand and later in a playing process but then in a kind of a random way, thus not self chosen by a player though utilizing a method to offer each player at least one playing card in addition out a full and so out a separated deck within a value category, a shuffled deck within the particular pile up and requiring to be separated by sheets of paper in between the decks;

further providing a formula requiring a painter to artfully create and to artfully paint the different graphics and indicia due and thus requiring to illustrate the two faces, the front and the back faces of traditional playing and trading cards out of paper or plastic or similar due verbally described likes (as themes) and due correlating contents behind all the paintings and prints of all graphics for a front surface and same time for a back surface, following a method to provisionally print variable indicators first, such as a,b, and c etc. to all of the plain front faces of all different playing cards, at least to represent the eleven (11) indicators for the eleven (11) different paintings for the at least eleven (11) different main themes and graphics on the front faces of playing cards, while each variable indicator directed on a further numerical indicator such as 1., 2., and 3., etc. indicating all verbally described formulas for the at least eleven categories of the until now verbally given descriptions to determine the eleven different main themes for the paintings on the front surfaces while these descriptions stated within the particular part of the DETAILED DESCRIPTION of this application, here excerpted the beginning paragraph on page 57 with: —1. the parameters for this style are describing the disicipline in a conservative understanding. The romantical, waving, dancing and good mood discipline while the corresponding style is including the parameters for the hard working, sweat inhaling and slow steel and the gentle manner discipline—(and excerpted the ending paragraph on page 59 with:)—11. this eleventh style and discipline is including the parameters of the centrifugal, the ice dancing and the clear water discipline while the corresponding parameters are including at least the storming, the cyclone and the shaggy player discipline, —all at least eleven (11) formulas for the different likes of different players requiring a further method to paint the different parameters just due one main graphic at all but usually due an artfully created "mirror-image" including two graphics for one corresponding main graphic on a front surface of a legal playing card, mirroring the two corresponding styles as genders immanent and different understandings directed on one and the same like (as a theme), requiring to initiate a players process to imaginary fuse the two mirrored graphics, divided by a fine line in the mid of a front surface face of a card, and further requiring a correlation with all the parts of indicia on a particular back surface of a legal playing card;

while all of the at least two indicia on a back surface of a legal playing card the prints following a similar method to provisionally imprint variable indicators to each back surface first and requiring a painter to artfully create all correlating indicia, now provisionally indicated such as PS (in a verbally described meaning of a Pair99Symbol), PtyS (in a described meaning of a PersonalitySymbol) and SI (in a described meaning of a Secret Indcia) within an illustrated position on all back surfaces of all playing cards for the at least two kinds of decks; while the different indicia on each back surface further requiring a method to hint for a hidden front surface usually of a face down offered card due the concrete illustration of the indicia on a particular position of a back surface utilizing a print method to illustrate portions of an indicia such as a part of a heart on a back surface of a first card (usually of an offeror) and further in a combining manner to illustrate another part of that indicia or to illustrate a whole corresponding part of the particular indicia on a back surface of a second card (usually of an offeree); some indicia on a back surface utilizing a further print method to compare at least two particular portions of indicia on back surfaces to at least two related playing cards due a different information shown by a particular color, or by a particular form or by a particular combination of form, graphic and color at all; while all at least so illustrated indicia on a particular position of a back surface and in a particular indicia-color directed to be found as a fitting complement in comparison to at least one other part of an indicia on a back surface of a particular second playing card including a rule that in case of a fitting color on the back surfaces of the particular cards the fit is proved as two identical front faces for certain nevertheless the still hidden front face of one offered card, while in case of all of other combinations all indicia signaling the players at least an uncertain to certain guess for a fitting front face usually in hand of an offeree;

selling, by a dealer, at least one playing card to each of a plurality of players based on a determination of each player such that each player has a hand of between one and five playing cards;

signaling, by the dealer, the start of a hand of the social card game;

selecting, by the dealer, a first player to begin the social card game;

providing, by the first player in a non-verbal manner, at least one playing card to offer to a second player chosen by the first player, wherein the at least one playing card is given to the dealer to place in front of the second player;

selecting, by the second player, one of the at least three frames indicated by the capital letters (W), (SB) or (P) to place the offered card; and determining a process, based on the which one of the at least three frames that the offered playing card is placed by an offeree, at least one of:

to continue play with another player without loss of the offered playing card;

to continue play with another player with loss of the offered playing card; or to continue play because the second player directed the dealer to turn the offered card face-up; all particular continuing processes directed on all provided processes behind the options within the particular imprint on a legal surface.

2. The game system of claim 1, further comprising, if play continued due a card on a particular frame and indicia because a second player directs a dealer to turn the offered card face-up, receiving, by a dealer, a game card from a second player that matches the offered game card of a first player in an attempt to complete a win; that match of the particularly shown front faces of at least two playing cards requiring a pre-method to hand each player around a game card table at least a particular first kind deck from the begin while all of the handed first kind decks for all of the players around a particular game card table at least requiring to exactly provide the same arrangement of playing cards and at least of same front surfaces just different in particular while all by a player self chosen front surfaces for a articular five cards in hand rule including whether at most five different front surfaces on all game cards in hand or five of the same front surfaces on all game cards in hand or all of other combinations inbetween and less inbetween; chosen to communicate and to reach a pair of cards and thus a pair of consenting players at last.

3. The game system of claim 2, further comprising after play continued due particular pair cards laved down and shown as a match of front faces of at least two playing cards on a particular frame and in a further consequence to be placed a time on a particular frame imprinted one of the two sideboard surfaces:

directing, by a dealer, a first player and a second player to take a time out at a location away from a play surface lasting a predetermined amount of time; and determining, by a dealer after a time out, if a win occurred based on an affirmation from both the first and second players that they wish to spend more time together.

4. The game system of claim 1, further comprising, if play continued due an offered card on a particular frame because a second player directs a dealer to turn the offered card face-up and the second player does not have a matching game card, purchasing, by a second player at least one additional game card, out of a shuffled second kind deck out a value category within a pile up in front of a dealer, to attempt to match the offered game card of the first player to complete the win.

5. The game system of claim 4, further comprising, when a purchased card matches the offered game card and is played by the second player:

directing, by a dealer, the first player and the second player to take a time out at a location away from a play surface lasting a predetermined amount of time; and determining, by a dealer after a time out, if a win occurred based on an affirmation from both the first and second players that they wish to spend more time together.

6. The game system of claim 1, wherein a plurality of players comprises at least four though usually required six players.

7. The game system of claim 1, further comprising, prior to selling at least one playing card out a first kind deck, a dealer offering to aid at least one player to decide a correct amount of playing cards for the at least one player to purchase.

8. The game system of claim 7, wherein an offer to aid the at least one player comprises:

quizzing, by a dealer, the at least one player individually in accordance with a determined questionnaire in a method utilizing also one comprehension for different questions within a question and each question utilizing at least three possible answers and notions, although all of these questions to be answered due one of the general answer statements included the questionnaire;

calculating, based on the responses, a correct amount of playing cards as an optimized amount of cards in hand for the at least one player to purchase; and verbally advising the at least one player of a correct amount of playing cards to purchase.

9. The game system of claim 8, wherein calculating comprises utilizing, by a dealer, a predetermined formula to value each answer due related impact points and adding the value to generate a number that corresponds to an optimized correct number of playing cards for the at least one player to purchase.

10. The game system of claim 1, wherein at least some of the social game cards are utilized as playing cards and as trading cards due a ruled process directed by a dealer to offer at least one of a winning pair card at least one of a winning pair or future couple to take it with and later to utilize it as a trading card instead of a related money for a win, while the amount of money to be paid as a win is at least a doubled amount of each value behind each winning pair card out of at least three value categories, while these categories requiring at least two different sub categories for parallel offered values behind playing cards for two different kinds of players, youth and adults, around a particular game card table; thus the decks offered at different tables including playing cards of at least a value of 2.00 or 20.00 EUR/USD; a vlaue of 5.00 or 50.00 EUR/USD or a category of 10.00 or 100.00 EUR/USD while the less amount directed on a game card table for the youth and the other amount directed on a table for adults.

11. The game system of claim 1, wherein at least some of the social game cards include a front face comprising indicia and a back face including further indicia, wherein the front face indicia and the back face indicia are important to game play, thus both faces communicating a main like in principle at least due a hint of all indicia on the back surfaces for an usually hidden front face of a face down offered card while utilizing a combined method to forward a first offered card face down to a particular indicia or frame on a play surface with a particularly directed meaning behind, such as WELCOME, STAND BY or PASS and thus to initiate an indicia-graphic-communication system utilizing all information imprinted all graphics and indicia in a significant importance.

12. The game system of claim 1, further comprising providing an additional indicia for a jumper position on a playing surface indicating where another player may be permitted to fill in for a missing player for a play with a maximum amount of one playing card at one table for one time, Jumper related and thereafter to win the turn or obligated to leave the table.

13. The game system of claim 1, further comprising, prior to signaling the start of a hand and if at least one player position is open, providing, by the dealer, at least one game-related expressis verbis inducement to encourage at least one customer around a game card table to become players of the social card game due free cards as a gratification.

14. The game system of claim 13, wherein the game-related inducement comprises at least one of an ANGEL'S GOLD free card and a BIT'S GOLD free card, a copy of a legal playing card out of paper or plastic or similar utilizing a method to always indicate and imprint a color frame of a highest value category each back surface of these special free cards, thus showing the highest value of a legal playing card such as a gold color for a 10.00 or for a 100.00 EUR/USD card while in difference to a regular playing card of a highest value the legal value of that card is truly the lowest value of all legal playing cards and thus requiring a frame construction on each back surface including diagonally overprinted capital letters for the word "FREE"; an overprint in such a slight manner that the imprint and thus the special name of these special cards hardly to find out after an ordinary look at a back face of this playing and trading card usually given as a free gratification.

15. The game system of claim 14, wherein the ANGEL's GOLD card and the BIT's GOLD card comprise golden cards that have a monetary value different the legal playing card of a highest value and that can be used to play the social card game within a predetermined time frame due a traditional time stamp usually and discretely imprinted the front face.

16. The game system of claim 1, further comprising at least one player communicating special interests and feelings by silent, non-verbal play and with unique images artfully painted on at least one of the front or back faces of the game playing cards.

17. The game system of claim 1, wherein in addition to matching the offered game card of the first player to a game card of a second player, a consenting opinion of the first and second player is required to build a win of the social card game for the first and second players.

18. The game system of claim 1, wherein even if an offered game card of a first player is matched to a game card in the hand of a second player and is forwarded to a frame on a legal surface indicated by a capital letter P before, if either of the first and second player has a dissenting opinion then the dealer wins.

19. The game system of claim 1, wherein the playing surface is part of a game card table comprising a plurality of seats for a plurality of players.

20. The game system of claim 19, further comprising a customer area behind a plurality of seats wherein customers having ANGEL's GOLD cards or a BIT's GOLD cards observe game for a right moment to play the social card game.

* * * * *